US012758025B2

(12) United States Patent
Griffith et al.

(10) Patent No.: US 12,758,025 B2
(45) Date of Patent: Oct. 13, 2026

(54) BED WITH STRAPS AND CONNECTORS

(71) Applicant: SNBR INC., Minneapolis, MN (US)

(72) Inventors: Matthew Griffith, Buffalo, MN (US); Antony Kirk, Minnetonka, MN (US); Hummy Truh, Oak Grove, MN (US); Brian Doffing, Arden Hills, MN (US)

(73) Assignee: Sleep Number Corporation

( * ) Notice: Subject to any disclaimer, the term of this patent is extended or adjusted under 35 U.S.C. 154(b) by 21 days.

(21) Appl. No.: 18/597,079

(22) Filed: Mar. 6, 2024

(65) Prior Publication Data

US 2024/0298809 A1 Sep. 12, 2024

Related U.S. Application Data

(60) Provisional application No. 63/450,214, filed on Mar. 6, 2023.

(51) Int. Cl.
*A47C 21/02* (2006.01)
*A47C 20/04* (2006.01)

(52) U.S. Cl.
CPC ..... *A47C 21/02* (2013.01); *A47C 20/048* (2013.01)

(58) Field of Classification Search
CPC ..... A47C 21/02; A47C 21/026; A47C 20/048; A47C 31/00; A47C 31/02; B64D 11/0696
USPC ..... 5/411
See application file for complete search history.

(56) References Cited

U.S. PATENT DOCUMENTS 679,656 A * 7/1901 Whiting ..... A61G 7/05 126/307 A
1,559,119 A * 10/1925 Miller ..... A47C 21/026 5/411
1,842,873 A 1/1932 Leeking
1,948,841 A * 2/1934 Cane ..... A47C 21/022 5/411
2,257,554 A * 9/1941 Hitchcock ..... A47C 21/026 5/411
2,588,854 A * 3/1952 Lang ..... A61G 7/015 5/411
2,995,762 A * 8/1961 Albinson ..... A47C 23/00 5/411
3,520,030 A * 7/1970 Hawkings ..... A47C 21/026 24/72.5
4,297,754 A * 11/1981 Zuniga ..... A47C 21/026 5/411
4,644,597 A 2/1987 Walker
4,766,628 A 8/1988 Walker
4,788,729 A 12/1988 Walker
(Continued)

FOREIGN PATENT DOCUMENTS

GB 2492571 1/2013
GB 2492571 A * 1/2013 ..... A47C 20/04
WO WO-9944476 A1 * 9/1999 ..... A47C 21/028

OTHER PUBLICATIONS

U.S. Appl. No. 09/471,592, Shafer, filed Dec. 23, 1999.
(Continued)

*Primary Examiner* — David R Hare

(74) *Attorney, Agent, or Firm* — Norton Rose Fulbright US LLP

(57) ABSTRACT

Bed systems include a mattress that is configured to be attached to a foundation. The bed systems include a strap and a connector configured to hold the strap and connect the mattress and the foundation to each other.

20 Claims, 14 Drawing Sheets

(56) References Cited

U.S. PATENT DOCUMENTS

D300,194 S 3/1989 Walker
4,829,616 A 5/1989 Walker
4,890,344 A 1/1990 Walker
4,897,890 A 2/1990 Walker
4,899,404 A * 2/1990 Galumbeck ..... A47C 20/041 5/616
4,908,895 A 3/1990 Walker
D313,973 S 1/1991 Walker
4,991,244 A 2/1991 Walker
5,144,706 A 9/1992 Walker
5,170,522 A 12/1992 Walker
D368,475 S 4/1996 Scott
5,509,154 A 4/1996 Shafer et al.
5,564,140 A 10/1996 Shoenhair et al.
5,642,546 A 7/1997 Shoenhair
5,642,547 A 7/1997 Hutton et al.
5,652,484 A 7/1997 Shafer et al.
5,765,246 A 6/1998 Shoenhair
5,903,941 A 5/1999 Shafer et al.
5,904,172 A 5/1999 Gifft et al.
6,037,723 A 3/2000 Shafer et al.
6,108,844 A 8/2000 Kraft et al.
6,161,231 A 12/2000 Kraft et al.
6,202,239 B1 3/2001 Ward et al.
6,397,419 B1 6/2002 Mechache
6,483,264 B1 11/2002 Shafer et al.
6,686,711 B2 2/2004 Rose et al.
6,687,935 B2 2/2004 Reeder et al.
6,708,357 B2 3/2004 Gaboury et al.
6,763,541 B2 7/2004 Mahoney et al.
6,804,848 B1 10/2004 Rose
6,832,397 B2 12/2004 Gaboury et al.
D502,929 S 3/2005 Copeland et al.
6,883,191 B2 4/2005 Gaboury et al.
7,389,554 B1 6/2008 Rose
7,669,259 B2 * 3/2010 Ganance ..... A61G 13/0009 5/624
7,810,194 B2 * 10/2010 Clenet ..... A47C 27/15 5/659
7,865,988 B2 1/2011 Koughan et al.
8,336,369 B2 12/2012 Mahoney
8,522,376 B2 * 9/2013 Rohr ..... A47C 21/026 5/692
D691,118 S 10/2013 Ingham et al.
D697,874 S 1/2014 Stusynski et al.
D698,338 S 1/2014 Ingham et al.
D701,536 S 3/2014 Shakal et al.
8,769,747 B2 7/2014 Mahoney et al.
8,856,985 B2 10/2014 Rensink et al.
8,893,339 B2 11/2014 Fleury et al.
8,931,329 B2 1/2015 Mahoney et al.
8,966,689 B2 3/2015 McGuire et al.
8,973,183 B1 3/2015 Palashewski et al.
9,003,583 B2 * 4/2015 Schnake ..... A47C 21/026 5/659
D728,254 S 5/2015 Blazar et al.
9,049,941 B2 * 6/2015 Clenet ..... A47C 21/026
D737,250 S 8/2015 Ingham et al.
9,107,782 B2 8/2015 Ermalovich
9,314,118 B2 4/2016 Blazar et al.
9,578,941 B2 2/2017 MacLachlan et al.
9,730,524 B2 8/2017 Chen et al.
9,737,154 B2 8/2017 Mahoney et al.
D809,843 S 2/2018 Keeley et al.
D812,393 S 3/2018 Karschnik et al.
9,924,813 B1 3/2018 Basten et al.
9,974,394 B2 5/2018 Brykalski et al.
10,143,312 B2 12/2018 Brosnan et al.
D840,732 S 2/2019 Peterson et al.
10,194,753 B2 2/2019 Fleury et al.
10,285,508 B2 5/2019 Rose et al.
D857,433 S 8/2019 Kiekhoefer et al.
10,531,745 B2 1/2020 McGuire et al.
10,539,170 B2 1/2020 Peterson et al.
10,575,654 B2 3/2020 Shakal
10,677,232 B2 6/2020 Shakal et al.
10,729,253 B1 8/2020 Gaunt
10,765,224 B2 9/2020 Chen et al.
10,813,470 B2 10/2020 Mahoney et al.
10,888,173 B2 1/2021 Shakal et al.
10,993,546 B2 5/2021 Shakal et al.
11,001,447 B2 5/2021 Shutes et al.
11,085,479 B2 8/2021 Griffith et al.
11,096,502 B2 8/2021 Rose et al.
D932,808 S 10/2021 Keeley
11,140,999 B2 10/2021 Peterson et al.
11,229,297 B2 1/2022 Gaunt
11,399,634 B2 8/2022 Aramli
11,484,128 B2 11/2022 Stusynski et al.
11,503,921 B2 * 11/2022 Sethapun ..... B64D 11/00
11,576,498 B1 * 2/2023 Stern ..... A47C 21/026
D982,360 S 4/2023 Negus
D1,032,243 S 6/2024 Negus et al.
2002/0069462 A1 6/2002 Gaboury et al.
2004/0045086 A1 3/2004 Zheng
2004/0128762 A1 * 7/2004 Weinman ..... A47C 21/026 5/411
2005/0204475 A1 9/2005 Schmitz et al.
2005/0235417 A1 10/2005 Koughan et al.
2008/0052830 A1 3/2008 Koughan et al.
2010/0043148 A1 2/2010 Rose et al.
2010/0050339 A1 * 3/2010 Beard ..... A47C 21/026 5/411
2014/0123390 A1 5/2014 Meyer et al.
2014/0250597 A1 9/2014 Chen et al.
2015/0007393 A1 1/2015 Palashewski
2015/0182418 A1 7/2015 Zaiss
2017/0049241 A1 2/2017 Grubb
2018/0125259 A1 5/2018 Peterson et al.
2019/0082855 A1 3/2019 Brosnan et al.
2019/0290012 A1 9/2019 Heeke et al.
2020/0187667 A1 6/2020 Shakal
2020/0359805 A1 11/2020 Brosnan et al.
2020/0375369 A1 12/2020 Negus et al.
2020/0400135 A1 12/2020 Shakal et al.
2021/0145183 A1 5/2021 Negus et al.
2021/0145185 A1 5/2021 Negus et al.
2021/0177155 A1 6/2021 McGuire et al.
2021/0244196 A1 8/2021 Hilden et al.
2021/0251392 A1 8/2021 Shakal
2021/0330090 A1 10/2021 Shakal et al.
2021/0341006 A1 11/2021 Griffith et al.
2021/0386212 A1 * 12/2021 Sethapun ..... A47C 31/00
2022/0192388 A1 6/2022 Smith et al.
2022/0218116 A1 7/2022 Rose et al.
2022/0273118 A1 9/2022 Peterson et al.
2022/0322840 A1 10/2022 Gaunt
2022/0354720 A1 * 11/2022 Miller ..... A61G 7/052
2022/0369827 A1 11/2022 Rose et al.
2023/0017015 A1 1/2023 Karschnik et al.
2023/0027288 A1 1/2023 Karschnik
2023/0031563 A1 2/2023 Molina et al.
2023/0057322 A1 2/2023 Shakal
2023/0063979 A1 3/2023 Doffing et al.
2023/0128215 A1 4/2023 Karschnik et al.
2023/0148764 A1 5/2023 Negus et al.
2023/0218088 A1 7/2023 Brosnan et al.
2023/0389717 A1 12/2023 Yang et al.
2024/0011476 A1 1/2024 Shakal et al.
2024/0016301 A1 1/2024 Karschnik et al.
2024/0074592 A1 3/2024 Gaunt
2024/0115055 A1 4/2024 Doffing et al.
2024/0115058 A1 4/2024 VerBockel et al.
2024/0148157 A1 5/2024 Stusynski et al.

OTHER PUBLICATIONS

U.S. Appl. No. 14/594,843, Rose et al., filed Jan. 12, 2015.
U.S. Appl. No. 18/196,658, Herman et al., filed May 12, 2023.
U.S. Appl. No. 18/435,583, Shakal et al., Feb. 7, 2024.
U.S. Appl. No. 18/441,524, Shakal., Feb. 14, 2024.
U.S. Appl. No. 18/613,830, Sullivan et al., filed Mar. 22, 2024.

(56) References Cited

OTHER PUBLICATIONS

U.S. Appl. No. 18/627,040, Smith et al., filed Apr. 4, 2024.
U.S. Appl. No. 29/719,090, filed Dec. 31, 2019, Negus et al.
U.S. Appl. No. 29/942,156, filed May 14, 2024, Negus et al.
International Search Report and Written Opinion in International Appln. No. PCT/US2024/018653, mailed on Jul. 12, 2024, 15 pages.
International Preliminary Report on Patentability in International Appln. No. PCT/US2024/018653, mailed on Sep. 18, 2025, 8 pages.

* cited by examiner

BED WITH STRAPS AND CONNECTORS

CROSS-REFERENCE TO RELATED APPLICATIONS

This application claims the benefit of U.S. Provisional Application Ser. No. 63/450,214, filed Mar. 6, 2023. The disclosure of the prior application is considered part of the disclosure of this application, and is incorporated in its entirety into this application.

The present document relates to consumer devices such as an airbed.

BACKGROUND

In general, a bed is a piece of furniture used as a location to sleep or relax. Many modern beds include a soft mattress on a bed frame or foundation that supports the mattress. The mattress may include springs, foam material, and/or an air chamber to support the weight of one or more occupants.

SUMMARY

Some implementations described herein include systems and methods related to consumer devices such as an air bed that include one or more attachment mechanisms to connect a mattress to a foundation. For example, a bed system can include a plurality of mattress attachment mechanisms that can include a strap and a connector assembly that is configured to hold the strap. The strap can have a first portion of a connector and the connector assembly can have a second portion of the connector that is configured to connect to the first portion to thereby connect and hold the mattress to the foundation.

Some implementations described herein include a bed system. The bed system includes a foundation and a mattress configured to be positioned on top of the foundation. The bed system also includes a mattress attachment mechanism configured to connect the mattress to the foundation, the mattress attachment mechanism may include: a strap configured to connect fixed to the mattress and extending from the mattress, the strap having a first portion of a connector; and a connector assembly fixed to the foundation and including (i) a channel partially recessed below a top surface of the foundation and configured to allow the strap to pass therethrough, (ii) a bar that extends across the channel, and (iii) a second portion of the connector, where the strap is configured to, based on passing through the channel, extend under the bar, and where the second portion of the connector is configured to, based on the strap passing through the channel, connect to the first portion of the connector.

Implementations described herein can include one or more optional features. For example, the bed system where the connector may include a snap, the first portion of the connector is a post foot that is attached to a surface of the foundation and the second portion of the connector is a snap socket that is attached to the strap. The snap socket is configured to align with the post foot when the strap extends through the channel. The post foot of the snap is partially recessed into the surface of the foundation to which the post foot is attached. The mattress attachment mechanism may include a reinforcement patch having a patch opening that is aligned with a fabric opening in a bottom layer of the mattress. The reinforcement patch has a first relief cut and a second relief cut. The patch opening includes a main slot and first and second lateral slots at each end of the main slot, the first and second lateral slots having widths less than the width of the main slot. The reinforcement patch is adhered to an internal side of the bottom layer of the mattress. The bed system may include a strap retainer attached to a loop of the strap, the strap retainer is positioned adjacent to an internal side of the bottom layer of the mattress. The bar may include a glass-filled nylon. The first portion of the connector may include a snap having a first snap portion attached to the strap and a second snap portion attached to a bottom of a panel of the foundation. The foundation may include a left head panel and a right head panel each having inner edges and outer edges, where the second snap portion is positioned proximate to the inner edge of one of the left head panel or the right head panel. The second strap is longer than the strap. The foundation may include an adjustable foundation configured for raising both a head and feet of the mattress when the adjustable foundation is actuated. The mattress attachment mechanism retains the mattress on the adjustable foundation during articulation of the adjustable foundation. The foundation may include a first articulable panel and a second articulable panel, the mattress attachment mechanism is positioned at a joint between the first and second panels.

In an example embodiment, a method of assembling a bed is provided. The method includes positioning a mattress on a foundation, the mattress having a strap extending therefrom, and the foundation having a connector assembly configured to engage the strap. The method also includes passing the strap of the mattress between a bar and a channel of the connector assembly of the foundation. The method also includes based on the strap passing between the bar and the channel of the connector assembly, connecting a first connector portion of strap to a second connector portion of the connector assembly to thereby connect the mattress to the foundation.

Implementations may include one or more of the following features. The method where the connector may include a snap, the first portion of the connector is a post foot that is attached to a surface of the foundation and the second portion of the connector is a snap socket that is attached to the strap. The snap socket is configured to align with the post foot when the strap extends through the channel. The post foot of the snap is partially recessed into the surface of the foundation to which the post foot is attached.

In an example embodiment, a bed system is provided. The bed system includes a foundation and a mattress configured to be positioned on top of the foundation. The bed system also includes a mattress attachment mechanism that may include: a strap configured to connect the mattress to the foundation; and a connector assembly configured to releasably hold the strap, the connector assembly may include an arm positioned at least partially in a channel configured to receive a portion of the strap, where the arm rotates between a locked position and an unlocked position, and in the locked position, the arm impinges the portion of the strap in the channel when the strap passes through the channel.

In an example embodiment, a bed system is provided. The bed system includes a foundation and a mattress configured to be positioned on top of the foundation. The bed system also includes a mattress attachment mechanism may include: a strap configured to connect the mattress to the foundation, the strap having a first portion of a hook-and-loop connector near an end of the strap; and a connector configured to hold the strap, the connector may include a second portion of the hook-and-loop connector, the second portion of the hook-and-loop connector configured to connect to the first portion of the hook-and-loop connector.

In an example embodiment, a bed system is provided. The bed system includes a foundation and a mattress configured to be positioned on top of the foundation. The bed system also includes a mattress attachment mechanism may include: a strap configured to connect the mattress to the foundation, a connector configured to hold the strap, and a strap retainer attached to a loop of the strap and positioned inside a mattress cover of the mattress.

In an example embodiment, a bed system is provided. The bed system includes a foundation and a mattress configured to be positioned on top of the foundation. The bed system also includes a mattress attachment mechanism may include: a strap configured to connect the mattress to the foundation, a connector configured to hold the strap, and a snap having a first snap portion attached to the strap and a second snap portion attached to either the mattress or the foundation.

Implementations may include one or more of the following features. The bed system where the first portion of the connector is a post foot that is attached to a surface of the foundation and the second portion of the connector is a snap socket that is attached to the strap. The first snap portion is configured to align with the second snap portion when the strap extends through a channel of the mattress attachment mechanism.

In an example embodiment, a bed system is provided. The bed system includes a foundation and a mattress configured to be positioned on top of the foundation, where the mattress may include a mattress cover with a cover opening. The bed system also includes a mattress attachment mechanism may include: a strap configured to connect the mattress to the foundation; a connector configured to hold the strap; and a reinforcement patch having a patch opening, where the reinforcement patch is positioned inside the mattress cover with the patch opening aligned with the cover opening.

Implementations may include one or more of the following features. The bed system where the reinforcement patch has a first relief cut and a second relief cut. The first relief cut is spaced inward of a perimeter of the reinforcement patch and spaced outward of the patch opening.

In an example embodiment, a bed system is provided. The bed system includes a foundation and a mattress configured to be positioned on top of the foundation. The bed system also includes a mattress attachment mechanism may include: a strap configured to connect the mattress to the foundation, and a connector configured to hold the strap and may include: a bar may include glass filled nylon positioned to support the strap.

In an example embodiment, a bed system is provided. The bed system includes a foundation having at least one articulable panel having a panel top surface and a panel bottom surface. The bed system also includes a mattress configured to be positioned on the panel top surface. The bed system also includes a mattress attachment mechanism may include: a strap configured to connect the mattress to the foundation; and a connector configured to hold the strap, where at least a portion of the connector is positioned on the panel bottom surface.

Implementations may include one or more of the following features. The bed system where at least one articulable panel may include a left head panel and a right head panel each having inner edges and outer edges, where the connector is positioned proximate to the inner edge of one of the left head panel or the right head panel.

In an example embodiment, a bed system is provided. The bed system also includes a foundation may include a left head panel and a right head panel each having inner edges and outer edges. The bed system also includes at least one mattress configured to be positioned on top of the foundation. The bed system also includes left and right mattress attachment mechanisms positioned proximate the inner edged of the left and right head panels, respectively, where the each of the left and right mattress attachment mechanisms may include: a strap configured to connect the at least one mattress to the foundation, and a connector configured to hold the strap.

Implementations may include one or more of the following features. The bed system where the at least one mattress may include a split-top mattress that defines a split at a head edge of the split-top mattress. The at least one mattress may include first and second separate mattresses that are each sized to fit on about half of the foundation.

In an example embodiment, a bed system is provided. The bed system also includes a foundation may include at least one articulable head panel and at least one second panel. The bed system also includes at least one mattress configured to be positioned on top of the foundation. The bed system also includes a first mattress attachment mechanism may include: a first strap configured to connect the at least one mattress to the at least one articulable head panel, and a first connector configured to hold the first strap. The bed system also includes a second mattress attachment mechanism may include: a second strap configured to connect the at least one mattress to the at least one second panel, where the second strap is shorter than the first strap; and a second connector configured to hold the second strap The devices, systems, and techniques described herein may provide one or more of the following advantages. For example, the bed systems described herein facilitate an improved connection between a mattress and a foundation that can maintain consistent positioning of the mattress in relation to the foundation. This particularly benefits an articulable foundation. The bed systems described herein can also facilitate precise installation of a bed system that can have a mattress and a foundation because they are connectable to each other. The bed systems can provide intuitive and precise connector assemblies that facilitate connection of the mattress to the foundation. The bed systems described herein also advantageously improve contouring of the mattress between the articulable sections of the foundation. For example, the attachment mechanisms can reduce or minimize the gap between the mattress and the foundation. The reduced and/or minimized gap can provide improved contouring of the mattress to the foundation as the foundation is articulated into various positions.

The details of one or more implementations are set forth in the accompanying drawings and the description below. Other features, aspects and potential advantages will be apparent from the accompanying description and figures.

DESCRIPTION OF DRAWINGS

Like reference symbols in the various drawings indicate like elements.

DETAILED DESCRIPTION

This disclosure relates to bed systems (such as an airbed or other type of bed) that include a mattress and a foundation that can be connected to each other using, for example, mechanical mechanisms. The bed system can include one or more attachment mechanisms that can connect the mattress and the foundation to each other. For example, a bed system can include a plurality of mattress attachment mechanisms that can include a strap and a connector assembly that is configured to hold the strap. The strap can have a first portion of a connector and the connector assembly can have a second portion of the connector that connects to the first portion to connect the mattress to the foundation.

In some aspects, the strap and the connector assembly can constitute a connector. For example, the strap and the connector each can include corresponding portions of the connector that are connectable to each other. For example, the strap can include a connection portion at an end of the strap that is connectable to another connection portion that is provided at the connector assembly. The strap can connect to the connector assembly via connection between the connection portions. This connection connects and holds the mattress to the foundation.

Figure 1:
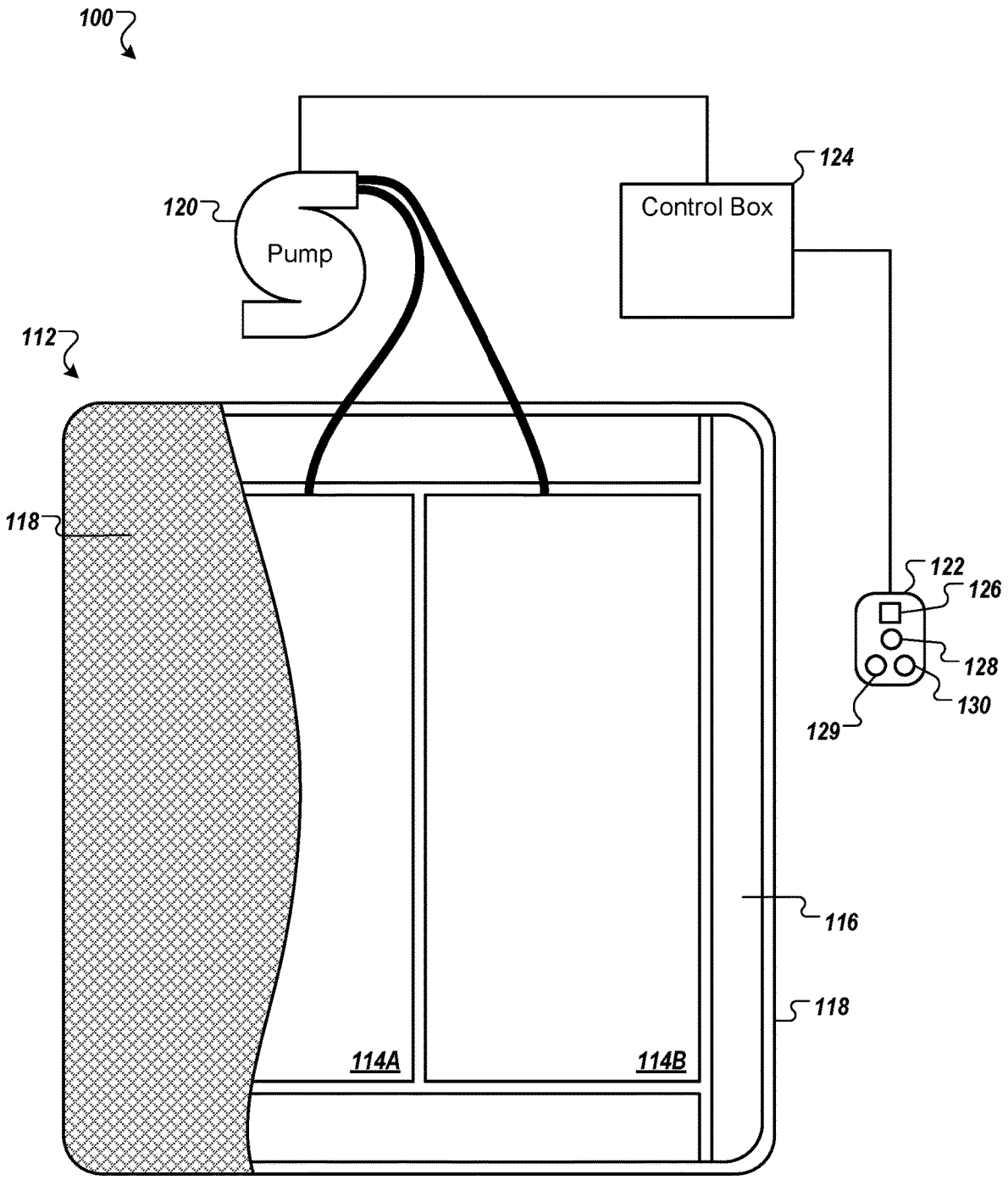
FIG. 1 shows an example air bed system.

In some aspects, the connection of the strap and connector assembly pulls the mattress and foundation together and reduces or minimizes a gap between the mattress and the foundation. The reduced and/or minimized gap can provide improved contouring of the mattress to the foundation as the foundation is articulated into various positions Example Airbed Hardware FIG. 1 shows an example air bed system 100 that includes a bed 112. The bed 112 can be a mattress that includes at least one air chamber 114 surrounded by a resilient border 116 and encapsulated by bed ticking 118. The resilient border 116 can comprise any suitable material, such as foam. In some implementations, the resilient border 116 can combine with a top layer or layers of foam (not shown in FIG. 1) to form an upside down foam tub. In other implementations, mattress structure can be varied as suitable for the application.

As illustrated in FIG. 1, the bed 112 can be a two chamber design having first and second fluid chambers, such as a first air chamber 114A and a second air chamber 114B. Sometimes, the bed 112 can include chambers for use with fluids other than air that are suitable for the application. For example, the fluids can include liquid. In some implementations, such as single beds or kids' beds, the bed 112 can include a single air chamber 114A or 114B or multiple air chambers 114A and 114B. Although not depicted, sometimes, the bed 112 can include additional air chambers.

The first and second air chambers 114A and 114B can be in fluid communication with a pump 120. The pump 120 can be in electrical communication with a remote control 122 via control box 124. The control box 124 can include a wired or wireless communications interface for communicating with one or more devices, including the remote control 122. The control box 124 can be configured to operate the pump 120 to cause increases and decreases in the fluid pressure of the first and second air chambers 114A and 114B based upon commands input by a user using the remote control 122. In some implementations, the control box 124 is integrated into a housing of the pump 120. Moreover, sometimes, the pump 120 can be in wireless communication (e.g., via a home network, WIFI, BLUETOOTH, or other wireless network) with a mobile device via the control box 124. The mobile device can include but is not limited to the user's smartphone, cell phone, laptop, tablet, computer, wearable device, home automation device, or other computing device. A mobile application can be presented at the mobile device and provide functionality for the user to control the bed 112 and view information about the bed 112. The user can input commands in the mobile application presented at the mobile device. The inputted commands can be transmitted to the control box 124, which can operate the pump 120 based upon the commands.

The remote control 122 can include a display 126, an output selecting mechanism 128, a pressure increase button 129, and a pressure decrease button 130. The remote control 122 can include one or more additional output selecting mechanisms and/or buttons. The display 126 can present information to the user about settings of the bed 112. For example, the display 126 can present pressure settings of both the first and second air chambers 114A and 114B or one of the first and second air chambers 114A and 114B. Sometimes, the display 126 can be a touch screen, and can receive input from the user indicating one or more commands to control pressure in the first and second air chambers 114A and 114B and/or other settings of the bed 112.

The output selecting mechanism 128 can allow the user to switch air flow generated by the pump 120 between the first and second air chambers 114A and 114B, thus enabling control of multiple air chambers with a single remote control 122 and a single pump 120. For example, the output selecting mechanism 128 can by a physical control (e.g., switch or button) or an input control presented on the display 126. Alternatively, separate remote control units can be provided for each air chamber 114A and 114B and can each include the ability to control multiple air chambers. Pressure increase and decrease buttons 129 and 130 can allow the user to increase or decrease the pressure, respectively, in the air chamber selected with the output selecting mechanism 128. Adjusting the pressure within the selected air chamber can cause a corresponding adjustment to the firmness of the respective air chamber. In some implementations, the remote control 122 can be omitted or modified as appropriate for an application.

Figure 2:
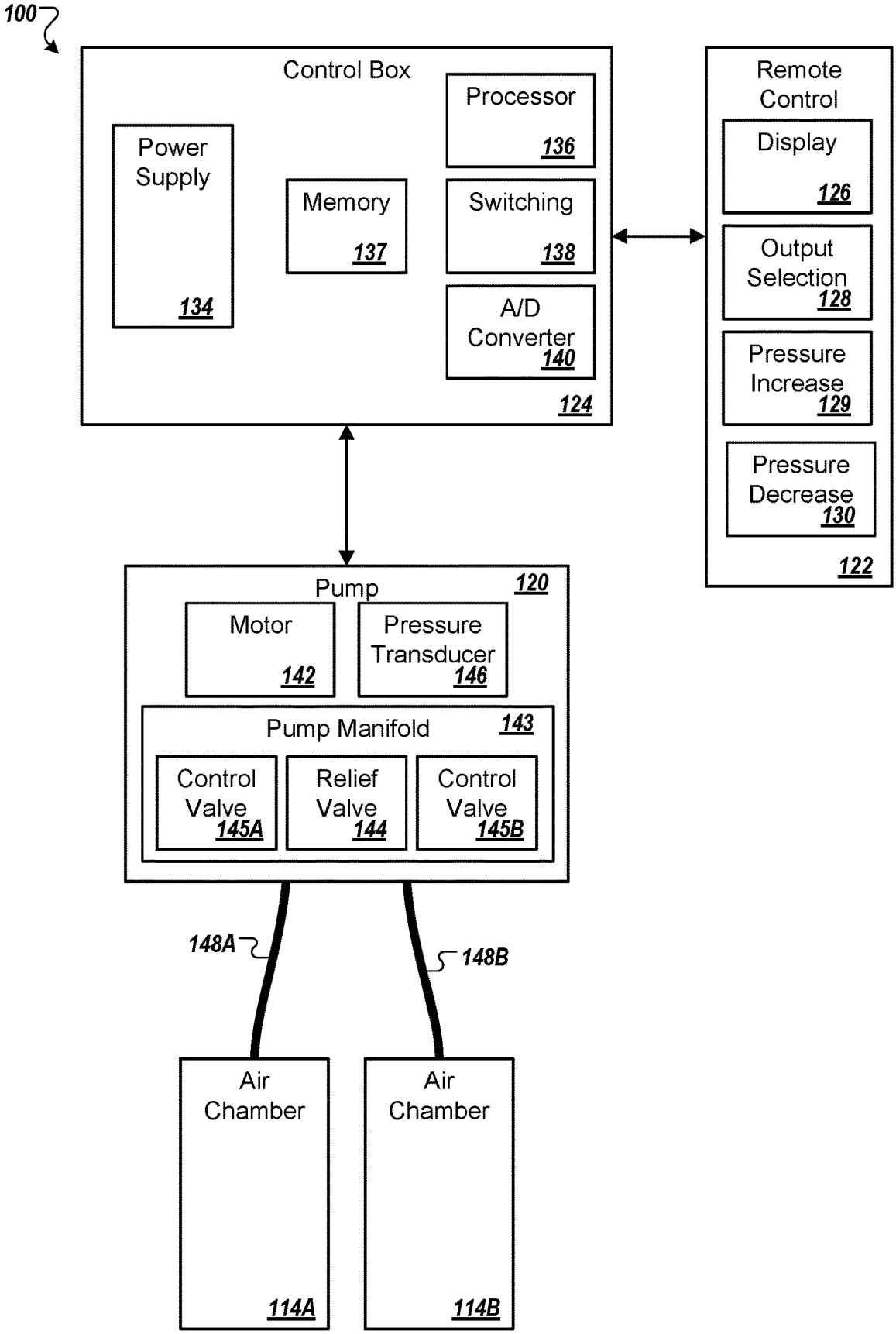
FIG. 2 is a block diagram of an example of various components of an air bed system.

FIG. 2 is a block diagram of an example of various components of an air bed system. These components can be used in the example air bed system 100. The control box 124 can include a power supply 134, a processor 136, a memory 137, a switching mechanism 138, and an analog to digital (A/D) converter 140. The switching mechanism 138 can be, for example, a relay or a solid state switch. In some implementations, the switching mechanism 138 can be located in the pump 120 rather than the control box 124. The pump 120 and the remote control 122 can be in two-way communication with the control box 124. The pump 120 includes a motor 142, a pump manifold 143, a relief valve 144, a first control valve 145A, a second control valve 145B, and a pressure transducer 146. The pump 120 is fluidly connected with the first air chamber 114A and the second air chamber 114B via a first tube 148A and a second tube 148B, respectively. The first and second control valves 145A and 145B can be controlled by switching mechanism 138, and are operable to regulate the flow of fluid between the pump 120 and first and second air chambers 114A and 114B, respectively.

In some implementations, the pump 120 and the control box 124 can be provided and packaged as a single unit. In some implementations, the pump 120 and the control box 124 can be provided as physically separate units. The control box 124, the pump 120, or both can be integrated within or otherwise contained within a bed frame, foundation, or bed support structure that supports the bed 112. Sometimes, the control box 124, the pump 120, or both can be located outside of a bed frame, foundation, or bed support structure (as shown in the example in FIG. 1).

The air bed system 100 in FIG. 2 includes the two air chambers 114A and 114B and the single pump 120 of the bed 112 depicted in FIG. 1. However, other implementations can include an air bed system having two or more air chambers and one or more pumps incorporated into the air bed system to control the air chambers. For example, a separate pump can be associated with each air chamber. As another example, a pump can be associated with multiple chambers. A first pump can be associated with air chambers that extend longitudinally from a left side to a midpoint of the air bed system 100 and a second pump can be associated with air chambers that extend longitudinally from a right side to the midpoint of the air bed system 100. Separate pumps can allow each air chamber to be inflated or deflated independently and/or simultaneously. Additional pressure transducers can also be incorporated into the air bed system 100 such that a separate pressure transducer can be associated with each air chamber.

As an illustrative example, in use, the processor 136 can send a decrease pressure command to one of air chambers 114A or 114B, and the switching mechanism 138 can convert the low voltage command signals sent by the processor 136 to higher operating voltages sufficient to operate the relief valve 144 of the pump 120 and open the respective control valve 145A or 145B. Opening the relief valve 144 can allow air to escape from the air chamber 114A or 114B through the respective air tube 148A or 148B. During deflation, the pressure transducer 146 can send pressure readings to the processor 136 via the A/D converter 140. The A/D converter 140 can receive analog information from pressure transducer 146 and can convert the analog information to digital information useable by the processor 136. The processor 136 can send the digital signal to the remote control 122 to update the display 126 to convey the pressure information to the user. The processor 136 can also send the digital signal to other devices in wired or wireless communication with the air bed system, including but not limited to mobile devices described herein. The user can then view pressure information associated with the air bed system at their device instead of at, or in addition to, the remote control 122.

As another example, the processor 136 can send an increase pressure command. The pump motor 142 can be energized in response to the increase pressure command and send air to the designated one of the air chambers 114A or 114B through the air tube 148A or 148B via electronically operating the corresponding valve 145A or 145B. While air is being delivered to the designated air chamber 114A or 114B to increase the chamber firmness, the pressure transducer 146 can sense pressure within the pump manifold 143. The pressure transducer 146 can send pressure readings to the processor 136 via the A/D converter 140. The processor 136 can use the information received from the A/D converter 140 to determine the difference between the actual pressure in air chamber 114A or 114B and the desired pressure. The processor 136 can send the digital signal to the remote control 122 to update display 126.

Generally speaking, during an inflation or deflation process, the pressure sensed within the pump manifold 143 can provide an approximation of the actual pressure within the respective air chamber that is in fluid communication with the pump manifold 143. An example method includes turning off the pump 120, allowing the pressure within the air chamber 114A or 114B and the pump manifold 143 to equalize, then sensing the pressure within the pump manifold 143 with the pressure transducer 146. Providing a sufficient amount of time to allow the pressures within the pump manifold 143 and chamber 114A or 114B to equalize can result in pressure readings that are accurate approximations of actual pressure within air chamber 114A or 114B. In some implementations, the pressure of the air chambers 114A and/or 114B can be continuously monitored using multiple pressure sensors (not shown). The pressure sensors can be positioned within the air chambers. The pressure sensors can also be fluidly connected to the air chambers, such as along the air tubes 148A and 148B.

In some implementations, information collected by the pressure transducer 146 can be analyzed to determine various states of a user laying on the bed 112. For example, the processor 136 can use information collected by the pressure transducer 146 to determine a heartrate or a respiration rate for the user. As an illustrative example, the user can be laying on a side of the bed 112 that includes the chamber 114A. The pressure transducer 146 can monitor fluctuations in pressure of the chamber 114A, and this information can be used to determine the user's heartrate and/or respiration rate. As another example, additional processing can be performed using the collected data to determine a sleep state of the user (e.g., awake, light sleep, deep sleep). For example, the processor 136 can determine when the user falls asleep and, while asleep, the various sleep states (e.g., sleep stages) of the user. Based on the determined heartrate, respiration rate, and/or sleep states of the user, the processor 136 can determine information about the user's sleep quality. The processor 136 can, for example, determine how well the user slept during a particular sleep cycle. The processor 136 can also determine user sleep cycle trends. Accordingly, the processor 136 can generate recommendations to improve the user's sleep quality and overall sleep cycle. Information that is determined about the user's sleep cycle (e.g., heartrate, respiration rate, sleep states, sleep quality, recommendations to improve sleep quality, etc.) can be transmitted to the user's mobile device and presented in a mobile application, as described above.

Additional information associated with the user of the air bed system 100 that can be determined using information collected by the pressure transducer 146 includes user motion, presence on a surface of the bed 112, weight, heart arrhythmia, snoring, partner snore, and apnea. One or more other health conditions of the user can also be determined based on the information collected by the pressure transducer 146. Taking user presence detection for example, the pressure transducer 146 can be used to detect the user's presence on the bed 112, e.g., via a gross pressure change determination and/or via one or more of a respiration rate signal, heartrate signal, and/or other biometric signals. Detection of the user's presence can be beneficial to determine, by the processor 136, adjustment(s) to make to settings of the bed 112 (e.g., adjusting a firmness when the user is present to a user-preferred firmness setting) and/or peripheral devices (e.g., turning off lights when the user is present, activating a heating or cooling system, etc.).

For example, a simple pressure detection process can identify an increase in pressure as an indication that the user is present. As another example, the processor 136 can determine that the user is present if the detected pressure increases above a specified threshold (so as to indicate that a person or other object above a certain weight is positioned on the bed 112). As yet another example, the processor 136 can identify an increase in pressure in combination with detected slight, rhythmic fluctuations in pressure as corresponding to the user being present. The presence of rhythmic fluctuations can be identified as being caused by respiration or heart rhythm (or both) of the user. The detection of respiration or a heartbeat can distinguish between the user being present on the bed and another object (e.g., a suitcase, a pet, a pillow, etc.) being placed thereon.

In some implementations, pressure fluctuations can be measured at the pump 120. For example, one or more pressure sensors can be located within one or more internal cavities of the pump 120 to detect pressure fluctuations within the pump 120. The fluctuations detected at the pump 120 can indicate pressure fluctuations in the chambers 114A and/or 114B. One or more sensors located at the pump 120 can be in fluid communication with the chambers 114A and/or 114B, and the sensors can be operative to determine pressure within the chambers 114A and/or 114B. The control box 124 can be configured to determine at least one vital sign (e.g., heartrate, respiratory rate) based on the pressure within the chamber 114A or the chamber 114B.

The control box 124 can also analyze a pressure signal detected by one or more pressure sensors to determine a heartrate, respiration rate, and/or other vital signs of the user lying or sitting on the chamber 114A and/or 114B. More specifically, when a user lies on the bed 112 and is positioned over the chamber 114A, each of the user's heart beats, breaths, and other movements (e.g., hand, arm, leg, foot, or other gross body movements) can create a force on the bed 112 that is transmitted to the chamber 114A. As a result of this force input, a wave can propagate through the chamber 114A and into the pump 120. A pressure sensor located at the pump 120 can detect the wave, and thus the pressure signal outputted by the sensor can indicate a heartrate, respiratory rate, or other information regarding the user.

With regard to sleep state, the air bed system 100 can determine the user's sleep state by using various biometric signals such as heartrate, respiration, and/or movement of the user. While the user is sleeping, the processor 136 can receive one or more of the user's biometric signals (e.g., heartrate, respiration, motion, etc.) and can determine the user's present sleep state based on the received biometric signals. In some implementations, signals indicating fluctuations in pressure in one or both of the chambers 114A and 114B can be amplified and/or filtered to allow for more precise detection of heartrate and respiratory rate.

Sometimes, the processor 136 can receive additional biometric signals of the user from one or more other sensors or sensor arrays positioned on or otherwise integrated into the air bed system 100. For example, one or more sensors can be attached or removably attached to a top surface of the air bed system 100 and configured to detect signals such as heartrate, respiration rate, and/or motion. The processor 136 can combine biometric signals received from pressure sensors located at the pump 120, the pressure transducer 146, and/or the sensors positioned throughout the air bed system 100 to generate accurate and more precise information about the user and their sleep quality.

Sometimes, the control box 124 can perform a pattern recognition algorithm or other calculation based on the amplified and filtered pressure signal(s) to determine the user's heartrate and/or respiratory rate. For example, the algorithm or calculation can be based on assumptions that a heartrate portion of the signal has a frequency in a range of 0.5-4.0 Hz and that a respiration rate portion of the signal has a frequency in a range of less than 1 Hz. Sometimes, the control box 124 can use one or more machine learning models to determine the user's health information. The models can be trained using training data that includes training pressure signals and expected heartrates and/or respiratory rates. Sometimes, the control box 124 can determine user health information by using a lookup table that corresponds to sensed pressure signals.

The control box 124 can also be configured to determine other characteristics of the user based on the received pressure signal, such as blood pressure, tossing and turning movements, rolling movements, limb movements, weight, presence or lack of presence of the user, and/or the identity of the user.

For example, the pressure transducer 146 can be used to monitor the air pressure in the chambers 114A and 114B of the bed 112. If the user on the bed 112 is not moving, the air pressure changes in the air chamber 114A or 114B can be relatively minimal, and can be attributable to respiration and/or heartbeat. When the user on the bed 112 is moving, however, the air pressure in the mattress can fluctuate by a much larger amount. The pressure signals generated by the pressure transducer 146 and received by the processor 136 can be filtered and indicated as corresponding to motion, heartbeat, or respiration. The processor 136 can attribute such fluctuations in air pressure to the user's sleep quality. Such attributions can be determined based on applying one or more machine learning models and/or algorithms to the pressure signals. For example, if the user shifts and turns a lot during a sleep cycle (for example, in comparison to historic trends of the user's sleep cycles), the processor 136 can determine that the user experienced poor sleep during that particular sleep cycle.

In some implementations, rather than performing the data analysis in the control box 124 with the processor 136, a digital signal processor (DSP) can be provided to analyze the data collected by the pressure transducer 146. Alternatively, the collected data can be sent to a cloud-based computing system for remote analysis.

In some implementations, the example air bed system 100 further includes a temperature controller configured to increase, decrease, or maintain a temperature of the bed 112, for example for the comfort of the user. For example, a pad (e.g., mat, layer, etc.) can be placed on top of or be part of the bed 112, or can be placed on top of or be part of one or both of the chambers 114A and 114B. Air can be pushed through the pad and vented to cool off the user on the bed 112. Additionally or alternatively, the pad can include a heating element used to keep the user warm. In some implementations, the temperature controller can receive temperature readings from the pad. The temperature controller can determine whether the temperature readings are less than or greater than some threshold range and/or value. Based on this determination, the temperature controller can actuate components to push air through the pad to cool off the user or active the heating element. In some implementations, separate pads are used for different sides of the bed 112 (e.g., corresponding to the locations of the chambers 114A and 114B) to provide for differing temperature control for the different sides of the bed 112. Each pad can be selectively controlled by the temperature controller to provide cooling or heating preferred by each user on the different sides of the bed 112. For example, a first user on a left side of the bed 112 can prefer to have their side of the bed 112 cooled during the night while a second user on a right side of the bed 112 can prefer to have their side of the bed 112 warmed during the night.

In some implementations, the user of the air bed system 100 can use an input device, such as the remote control 122 or a mobile device as described above, to input a desired temperature for a surface of the bed 112 (or for a portion of the surface of the bed 112, for example at a foot region, a lumbar or waist region, a shoulder region, and/or a head region of the bed 112). The desired temperature can be encapsulated in a command data structure that includes the desired temperature and also identifies the temperature controller as the desired component to be controlled. The command data structure can then be transmitted via Bluetooth or another suitable communication protocol (e.g., WIFI, a local network, etc.) to the processor 136. In various examples, the command data structure is encrypted before being transmitted. The temperature controller can then configure its elements to increase or decrease the temperature of the pad depending on the temperature input provided at the remote control 122 by the user.

In some implementations, data can be transmitted from a component back to the processor 136 or to one or more display devices, such as the display 126 of the remote controller 122. For example, the current temperature as determined by a sensor element of a temperature controller, the pressure of the bed, the current position of the foundation or other information can be transmitted to control box 124. The control box 124 can transmit this information to the remote control 122 to be displayed to the user (e.g., on the display 126). As described above, the control box 124 can also transmit the received information to a mobile device to be displayed in a mobile application or other graphical user interface (GUI) to the user.

In some implementations, the example air bed system 100 further includes an adjustable foundation and an articulation controller configured to adjust the position of the bed 112 by adjusting the adjustable foundation supporting the bed. For example, the articulation controller can adjust the bed 112 from a flat position to a position in which a head portion of a mattress of the bed is inclined upward (e.g., to facilitate a user sitting up in bed and/or watching television). The bed 112 can also include multiple separately articulable sections. As an illustrative example, the bed 112 can include one or more of a head portion, a lumbar/waist portion, a leg portion, and/or a foot portion, all of which can be separately articulable. As another example, portions of the bed 112 corresponding to the locations of the chambers 114A and 114B can be articulated independently from each other, to allow one user positioned on the bed 112 surface to rest in a first position (e.g., a flat position or other desired position) while a second user rests in a second position (e.g., a reclining position with the head raised at an angle from the waist or another desired position). Separate positions can also be set for two different beds (e.g., two twin beds placed next to each other). The foundation of the bed 112 can include more than one zone that can be independently adjusted.

Sometimes, the bed 112 can be adjusted to one or more user-defined positions based on user input and/or user preferences. For example, the bed 112 can automatically adjust, by the articulation controller, to one or more user-defined settings. As another example, the user can control the articulation controller to adjust the bed 112 to one or more user-defined positions. Sometimes, the bed 112 can be adjusted to one or more positions that may provide the user with improved or otherwise improve sleep and sleep quality. For example, a head portion on one side of the bed 112 can be automatically articulated, by the articulation controller, when one or more sensors of the air bed system 100 detect that a user sleeping on that side of the bed 112 is snoring. As a result, the user's snoring can be mitigated so that the snoring does not wake up another user sleeping in the bed 112.

In some implementations, the bed 112 can be adjusted using one or more devices in communication with the articulation controller or instead of the articulation controller. For example, the user can change positions of one or more portions of the bed 112 using the remote control 122 described above. The user can also adjust the bed 112 using a mobile application or other graphical user interface presented at a mobile computing device of the user.

The articulation controller can also provide different levels of massage to one or more portions of the bed 112 for one or more users. The user(s) can adjust one or more massage settings for the portions of the bed 112 using the remote control 122 and/or a mobile device in communication with the air bed system 100.

Figure 3A:
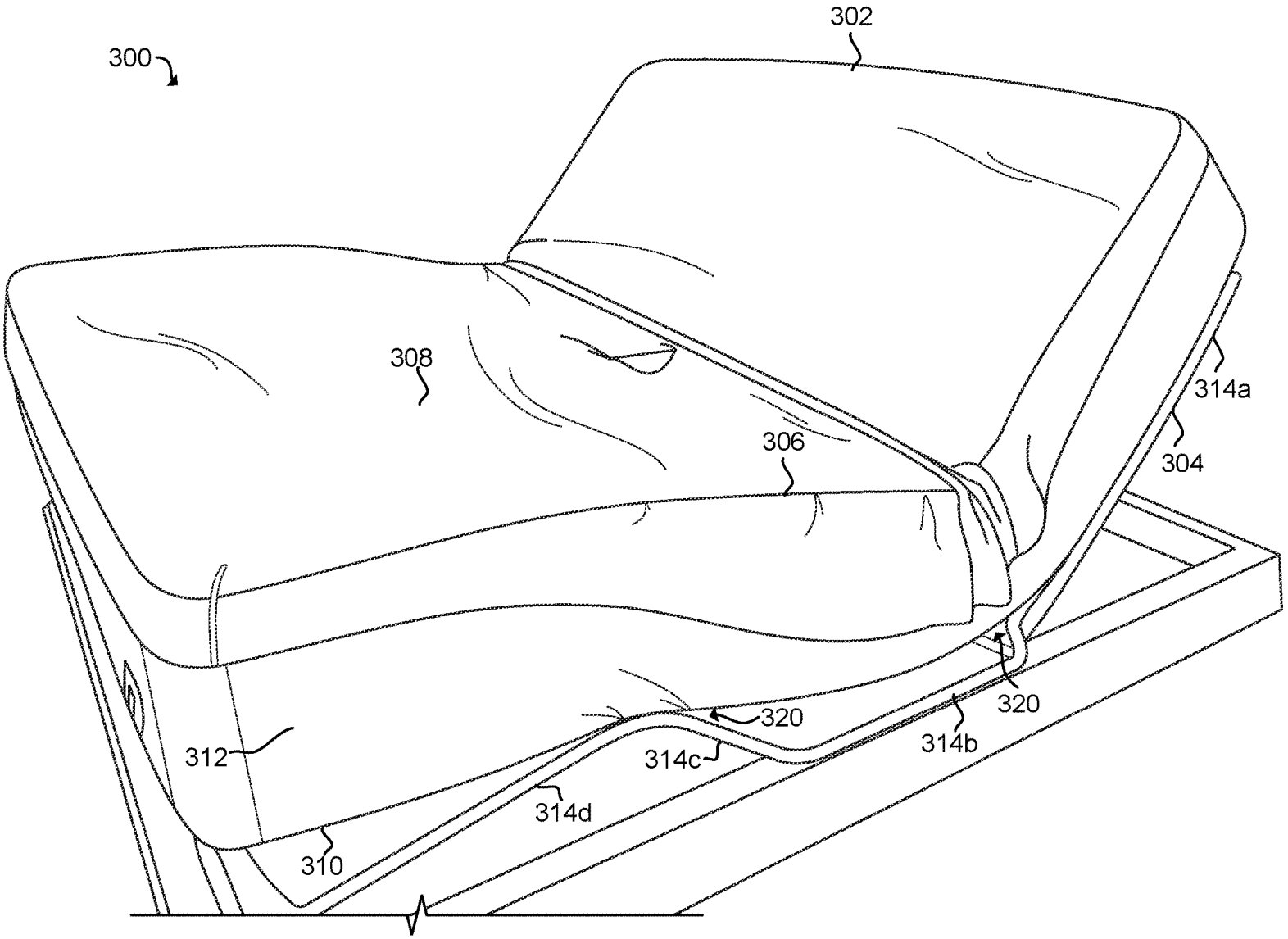
FIG. 3A is a perspective view of an example bed system with an adjustable frame.

FIG. 3A shows another example bed system 300 that includes a mattress 302 and an articulable foundation 304. The mattress 302 can be positioned on top of the foundation 304 to provide a comfortable, supportive sleep area for the user. The mattress 302 can include a support structure (see e.g., the air chambers 114A, 114B surrounded by the resilient border 116 as shown in FIG. 1) encapsulated by an outer fabric layer 306. The mattress 302 can include a top 308, a bottom 310, and sides 312 extending between the top 308 and the bottom 310. The foundation 304 can include one or more sections 314*a*, 314*b*, 314*c*, and 314*d*. One or more of the sections 314*a*, 314*b*, 314*c*, and 314*d* can be articulable sections for positioning various sections of the mattress 302 into various spatial configurations, as desired by the user. The foundation 304 can move into the various spatial configurations by changing the heights and adjusting the angles of one or more of its articulable sections 314*a*, 314*b*, 314*c*, and 314*d* relative to one another.

The bottom 310 of the mattress 302 can be coupled to the foundation 304 by one or more mattress attachment mechanisms 320 (further illustrated in FIG. 3B) such that the mattress 302 does not slide along a top surface of the foundation 304 when the articulable sections 314*a*, 314*b*, 314*c*, and 314*d* change their positions and can potentially move the mattress 302 thereon. This allows the mattress 302 to remain aligned with the foundation 304 when articulated such that the mattress 302 does not slide out of alignment with the foundation 304. The one or more mattress attachment mechanisms 320 hold the mattress 302 in position to prevent the mattress 302 from sliding off the foundation 304. The one or more mattress attachment mechanisms 320 reduces or minimizes a gap between the mattress 302 and the foundation 304. The one or more mattress attachment mechanisms 320 maintain the mattress 302 in a consistent and predictable position that prevents the mattress 302 from bunching against an adjacent structure such as a wall or a head or foot frame. The mattress attachment mechanisms 320 can thus provide a secure and reliable method of attaching or detaching the mattress 302 to the foundation 304.

Figure 3B:
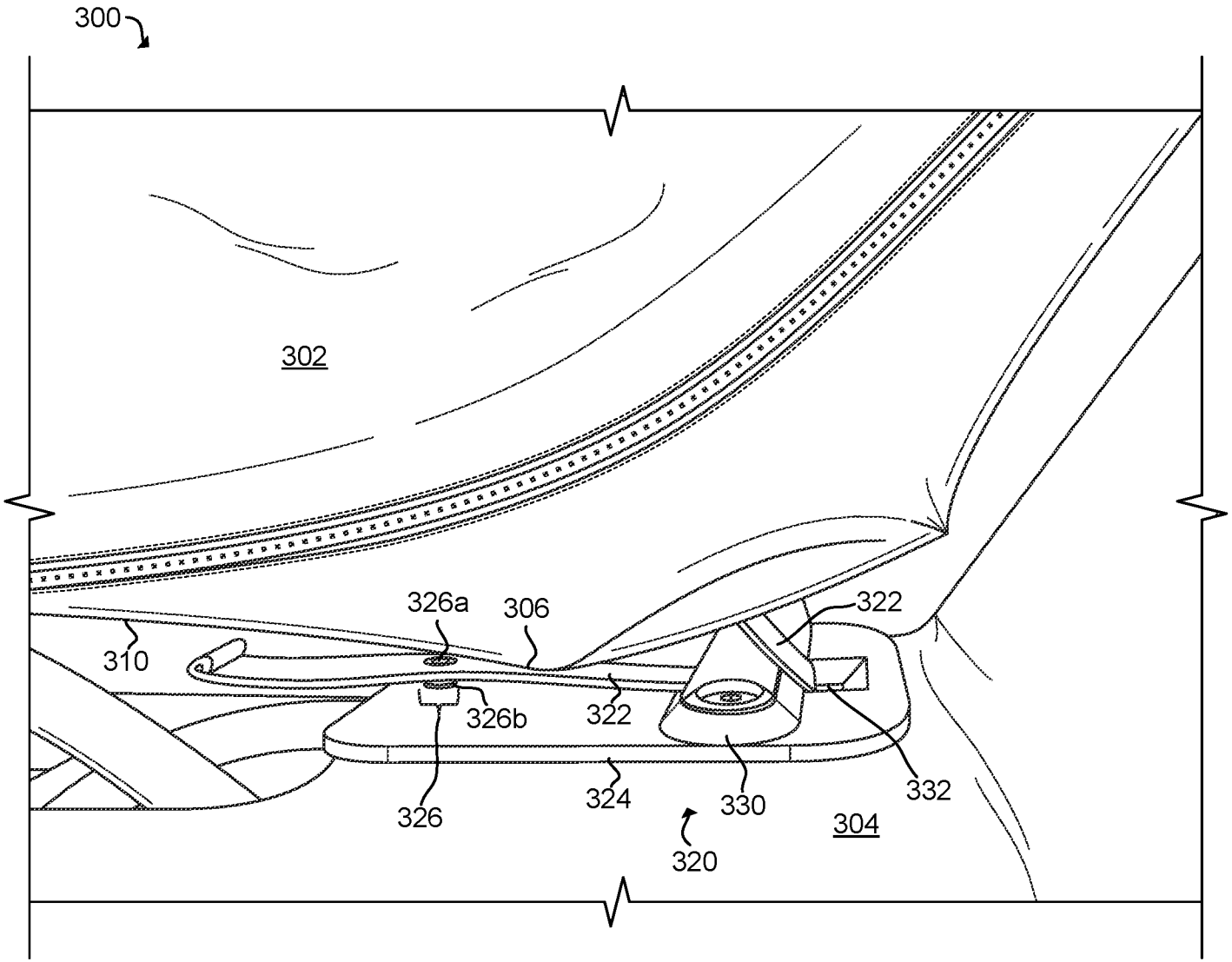
FIG. 3B is a detailed side view of an example attachment mechanism of the example bed system of FIG. 3A.

FIG. 3B shows a detailed view of a mattress attachment mechanism 320 coupling the mattress 302 to the foundation 304 of FIG. 3A. In the depicted implementation, the mattress attachment mechanism 320 can be attached to a portion of the mattress 302 (e.g., the outer fabric layer 306) and a portion of the foundation 304. Respective parts of the mattress attachment mechanism 320 can be attached to portions of the mattress 302 and foundation 304 by one or more mechanical fasteners (e.g., adhesive, a screw, a nut, a bolt, a staple, a hook, or the like). As shown in FIG. 3B, the outer fabric layer 306 can be elastic so as to at least partially stretch when the mattress attachment mechanism 320 is in tension. In some embodiments, the outer fabric layer 306 can be a stiff fabric that has little or no stretch when the mattress attachment mechanism 320 is in tension.

The mattress attachment mechanism 320 can include a strap 322 and a connector assembly 324. The strap 322 can be configured to connect the mattress 302 to the foundation 304. In some implementations, the strap 322 has a first portion 326*a* of a connector 326 at an end of the strap 322. The strap 322 can extend from the bottom surface 310 of the mattress 302, and the first portion 326*a* of the connector can be configured to connect to the connector assembly 324. In other implementations, the strap 322 can extend from the foundation 304 and connect to the mattress 302.

The connector assembly 324 can be attached to the foundation 304, and the connector assembly 324 can include a bar 330, a channel 332, and a second portion 326*b* of the connector 326. The bar 330 can extend across the channel 332, and the channel 332 can extend beneath the bar 330. In some implementations, the channel 332 has a depth to create an area for the strap 322 to pass between the bar 330 and the channel 332. In some embodiments, the depth of the channel 332 can create a recessed channel that has a depth that extends below the top surface of the foundation 404. In some embodiments, the bar 330 can be raised above a top surface of the connector assembly 324, and the strap 322 can pass between the bar 330 and the top surface of the connector assembly. The second portion 324*b* of the connector assembly 324 can be spaced apart from the bar 330 and can be configured to connect to the first portion 326*a* of the connector 326 to secure the strap 322 to the connector assembly 324. In other implementations, the connector assembly 324 can be attached to the mattress 302 and receive the strap 322 that extends from the foundation 304. With the strap 322 and the connector assembly 324 connected, the mattress 302 and the foundation 304 are connected to each other. The strap 322 and connector assembly 324 pulls the mattress 302 and foundation 304 together and reduces or minimizes a gap between the mattress 302 and the foundation 304. The reduced and/or minimized gap can provide improved contouring of the mattress 302 to the foundation 304 as the foundation 304 is articulated into various positions. An example of the connector assembly 324 is further described in FIG. 6 as a connector assembly 424.

Figure 4:
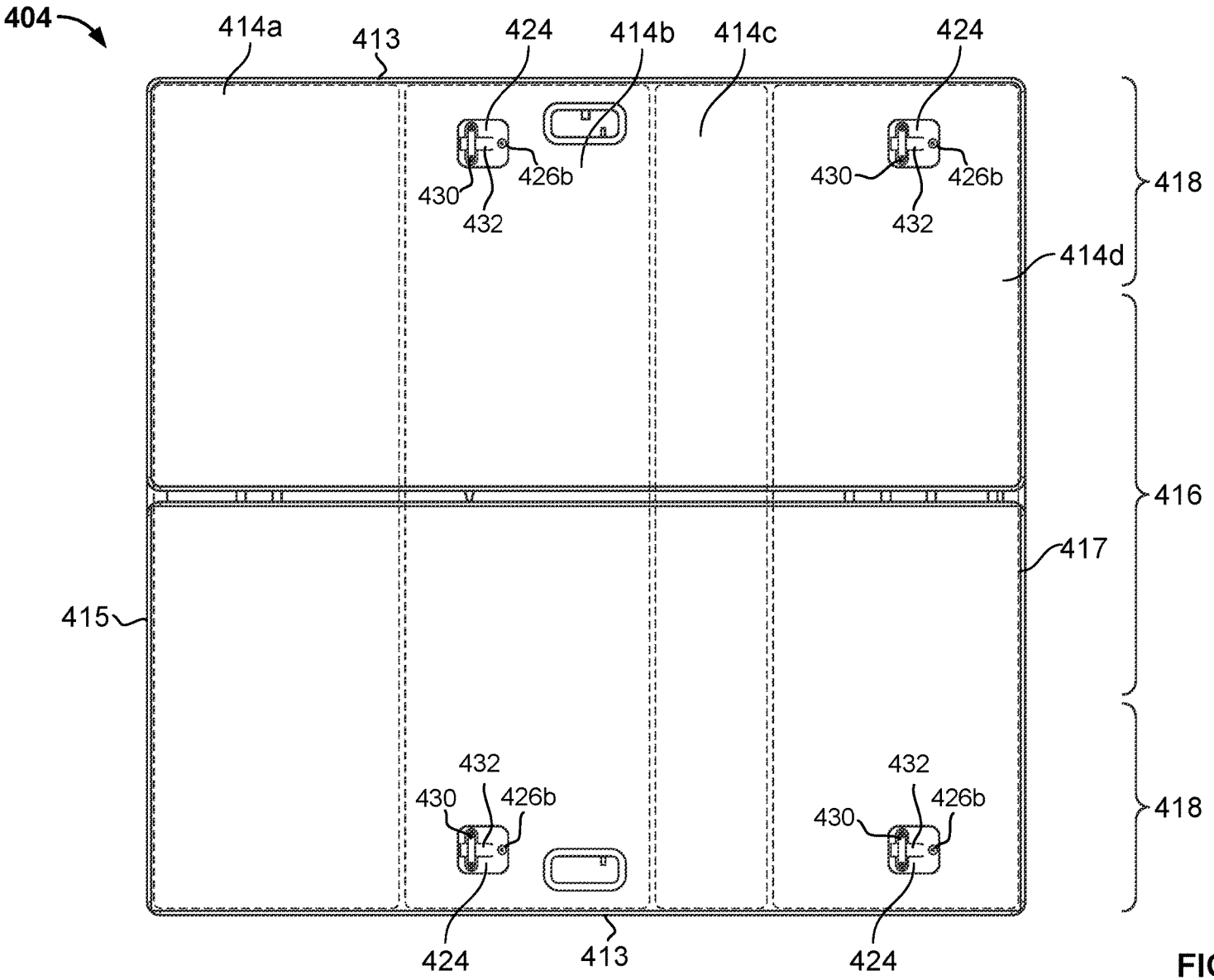
FIG. 4 is a top view of an example bed foundation with connector assemblies.

FIG. 4 shows a top view of an example foundation 404 including four locations for attaching a connector assembly 424. The depicted foundation 404 includes four sections: a head section 414*a*, an upper midsection 414*b*, a lower midsection 414*c*, and a foot section 414*d*. The foundation 404 can be sized and shaped for any mattress size, for example, a king, a split-top king, a queen, a full, a twin, a twin XL sized mattress, or a custom-sized mattress. The connector assemblies 424 can be positioned at one or more locations along a top surface of the foundation 404 such that connector assemblies 424 interface with one or more straps (e.g., straps 322, 522) to secure a mattress (e.g., a mattress 302, 502) to the foundation 404. In some implementations, the connector assemblies 424 can include various fastener assemblies, including snap-connectors, adjustable snap connectors, buckle connectors, Velcro®, hook and loop fasteners, cam-lock fasteners, adhesives, and combinations thereof.

In some cases, the foundation 404 can accommodate any number of connector assemblies 424 (e.g., two, three, four, five, six, eight, ten, twelve, fourteen, sixteen, eighteen, twenty, thirty, forty, fifty, or greater than fifty). In some cases, the connector assemblies 424 can be positioned at locations symmetrically along the foundation 404 (e.g., with respect to a longitudinal axis of the foundation 404) to facilitate securement and alignment of the mattress. In some instances, the positions of the connector assemblies 424 reduce or minimize the amount of shear force exerted on the mattress, preventing misalignment, separation, or detachment of the mattress from the foundation 404. Alternatively, in some cases, the connector assemblies 424 can be asymmetrically positioned along the surface of the foundation 404 to allow for easier movement and conformance of the mattress when the foundation 404 is articulated. For example, connector assemblies 424 can be positioned in areas such as at the peripheral portions 418 of the upper midsection 414*b* to provide improved conformance of the mattress to the foundation 404 when the foundation 404 is articulated. Connector assemblies 424 can additionally be positioned along the central portion 416 and/or the peripheral portions 418 in any of the head section 414*a*, the upper midsection 414*b*, the lower midsection 414*c*, and the foot section 414*d*. In an asymmetric arrangement, the connector assemblies 424 can be positioned at various locations along the central portion 416 to facilitate conformance of the mattress to the foundation 404 when the foundation 404 is articulated. The depicted foundation 404 can be compatible and couplable with a mattress (see e.g., mattress 502) having a complementary set of straps (e.g., straps 522) attached along the bottom surface of the mattress.

As shown in FIG. 4, the upper midsection 414*b* of the foundation 404 includes one set of two symmetrically positioned connector assemblies 424, and the foot section 414*d* includes a set of two symmetrically positioned connector assemblies 424. In some cases, some of the articulable sections of the foundation 404 may not include connector assemblies 424 (e.g., the head section 414*a* and the lower midsection 414*c*). In some cases, any one section of the foundation 404 can include one or more sets of connector assemblies 424. In some cases, any one section of the foundation 404 can include a single connector assembly 424 or a set of connector assemblies 424, either symmetrically or asymmetrically positioned.

The foundation 404 can include a central portion 416 that is positioned between peripheral portions 418. The peripheral portions 418 can extend from the central portion 416 to the sides 413 of the foundation 404. In the implementation depicted in FIG. 4, the connector assemblies 424 at the upper midsection 414*b* are located at peripheral portions 418 of the foundation 404. The connector assemblies 424 at the foot section 414*d* are positioned at peripheral portions 418 of the foundation 404.

Referring to FIG. 4, similarly to the connector assembly 324 above, each of the connector assemblies 424 includes a bar 430, a channel 432, and a connector 426 having first and second connector portions 426*a* and 426*b*. The connector assemblies 424 can be arranged on the foundation 404 so that the bar 430 that extends across the channel 432 is closer to the head end 415 than the second portion 426*b* of the connector 426. Said another way, the second portion 426*b* of each connector assembly 424 is arranged closer to the foot end 417 than the bar 430 of the connector assembly 424 is. In some cases, the connector assemblies 424 may be positioned on the foundation 404 such that the connector assemblies 424 can be easily accessed during assembly and/or disassembly of the bed system. An example of the connector assembly 424 is further described in FIG. 6.

Figure 5:
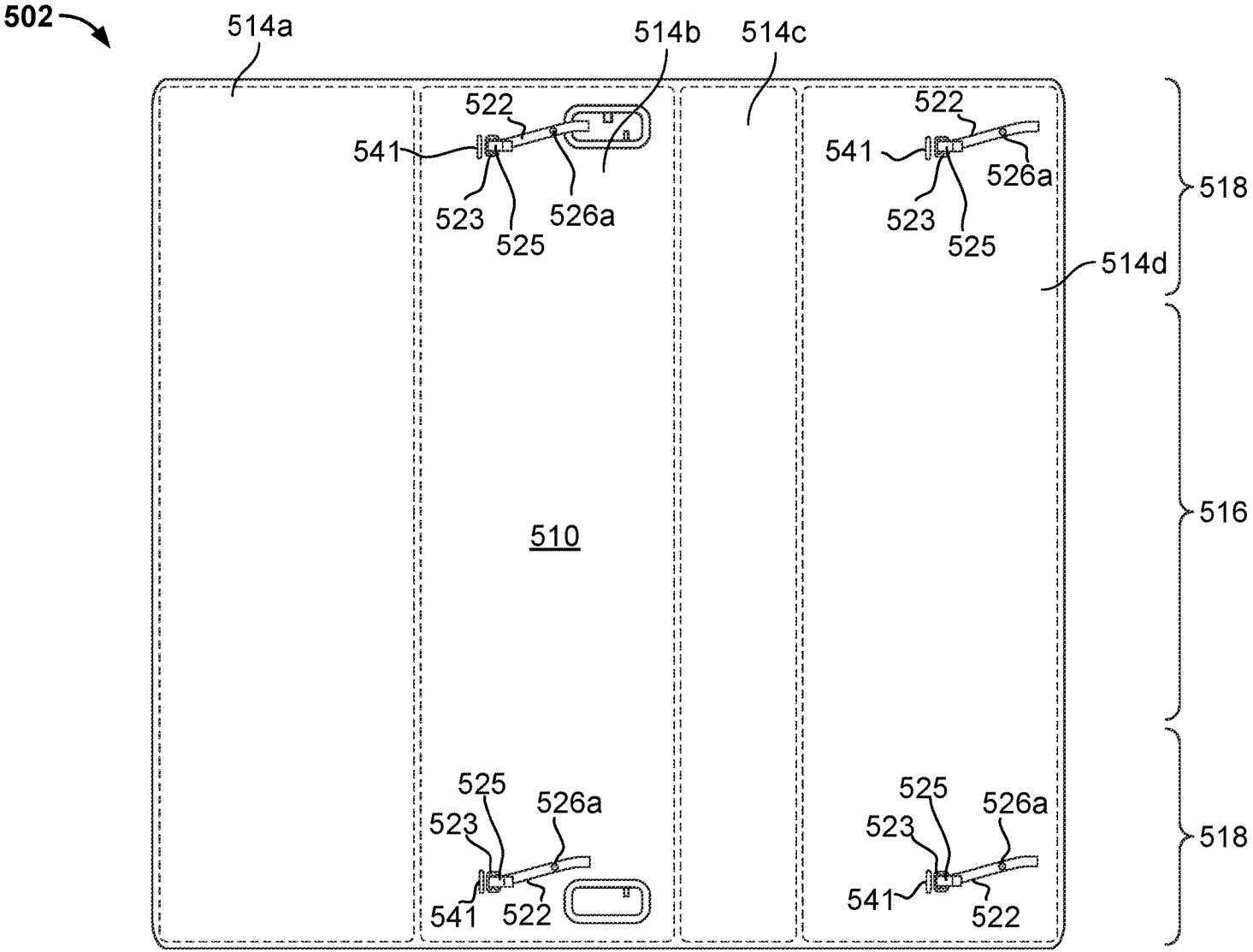
FIG. 5 is a bottom view of an example mattress with straps.

FIG. 5 shows a bottom view of an example mattress 502 including four locations for attaching a strap 522. The depicted mattress 502 can be sized and shaped as any mattress size, for example, a king, a split-top king, a queen, a full, a twin, a twin XL sized mattress, or a custom-sized mattress. The straps 522 can be arranged to correspond to the positions of the connector assemblies of the foundation to which the mattress is supported and coupled. The straps 522 can be positioned at one or more locations along a bottom surface of the mattress 502 such that straps 522 interface with one or more connector assemblies (e.g., connector assemblies 424) to secure the mattress 502 to a foundation (e.g., foundation 304, 404). In some implementations, the foundation 404 and the mattress 502 are configured to be connected to each other by connecting the straps 522 to the connector assemblies 424. The depicted mattress 502 can include four sections: a head section 514*a*, an upper midsection 514*b*, a lower midsection 514*c*, and a foot section 514*d* that can be configured to align with the head section 414*a*, an upper midsection 414*b*, a lower midsection 414*c*, and a foot section 414*d* of the foundation 404.

Figure 7:
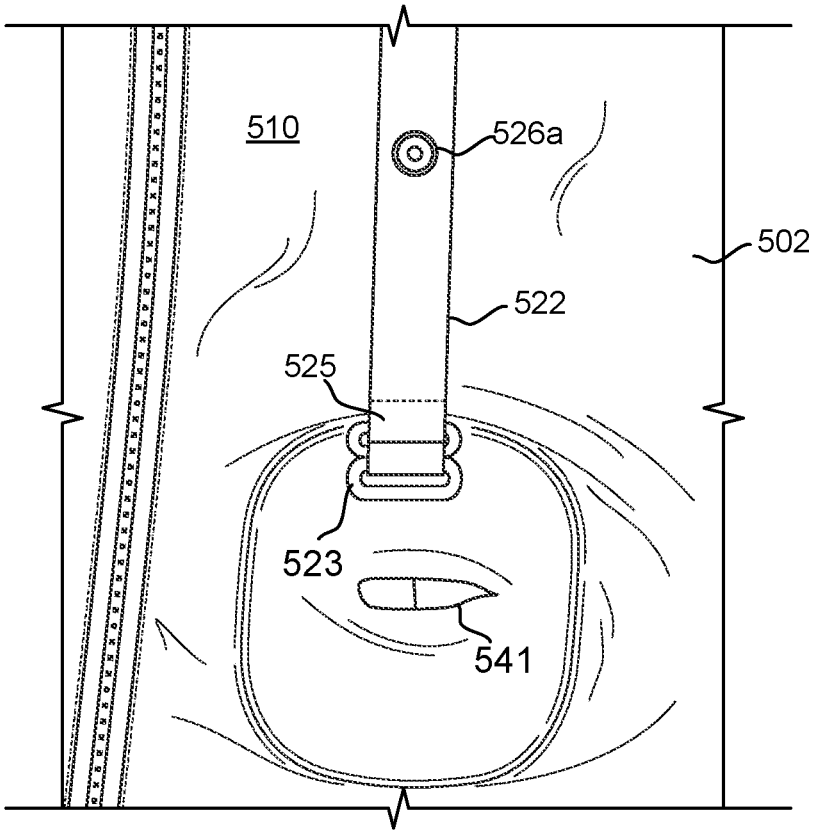
FIG. 7 is a bottom view of an example mattress opening for a strap.
Figure 8A:
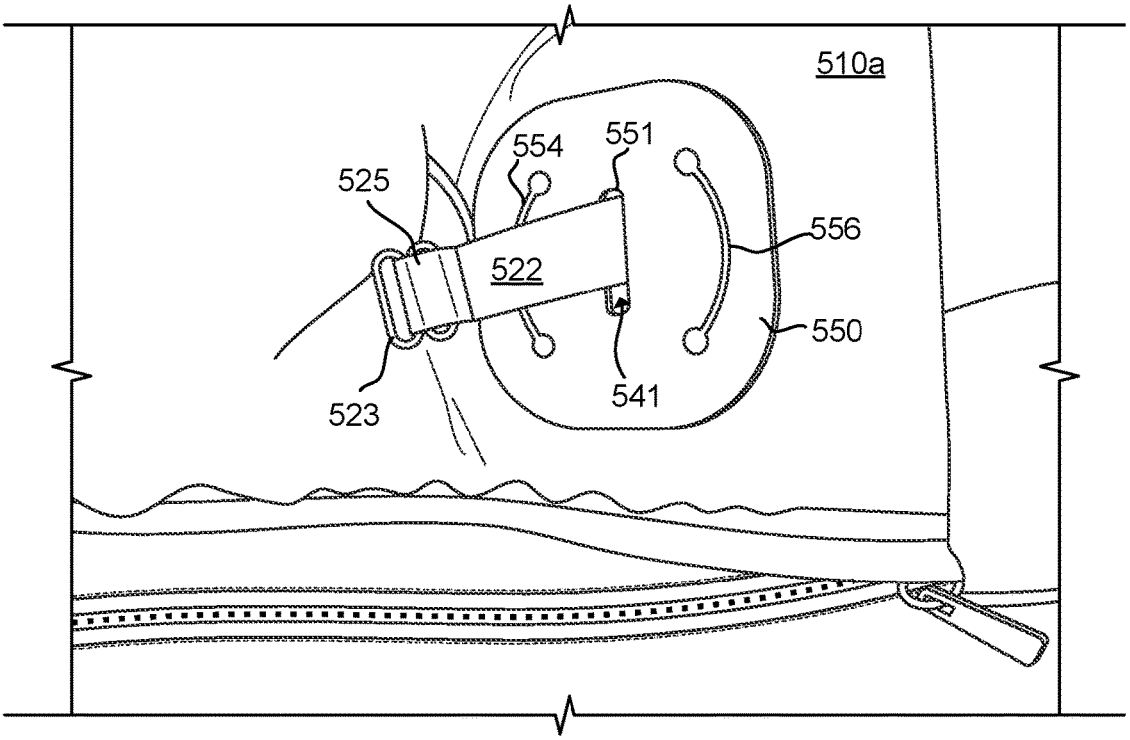
FIG. 8A is a top view of an internal side of a bottom layer of the mattress of FIG. 7.
Figure 8B:
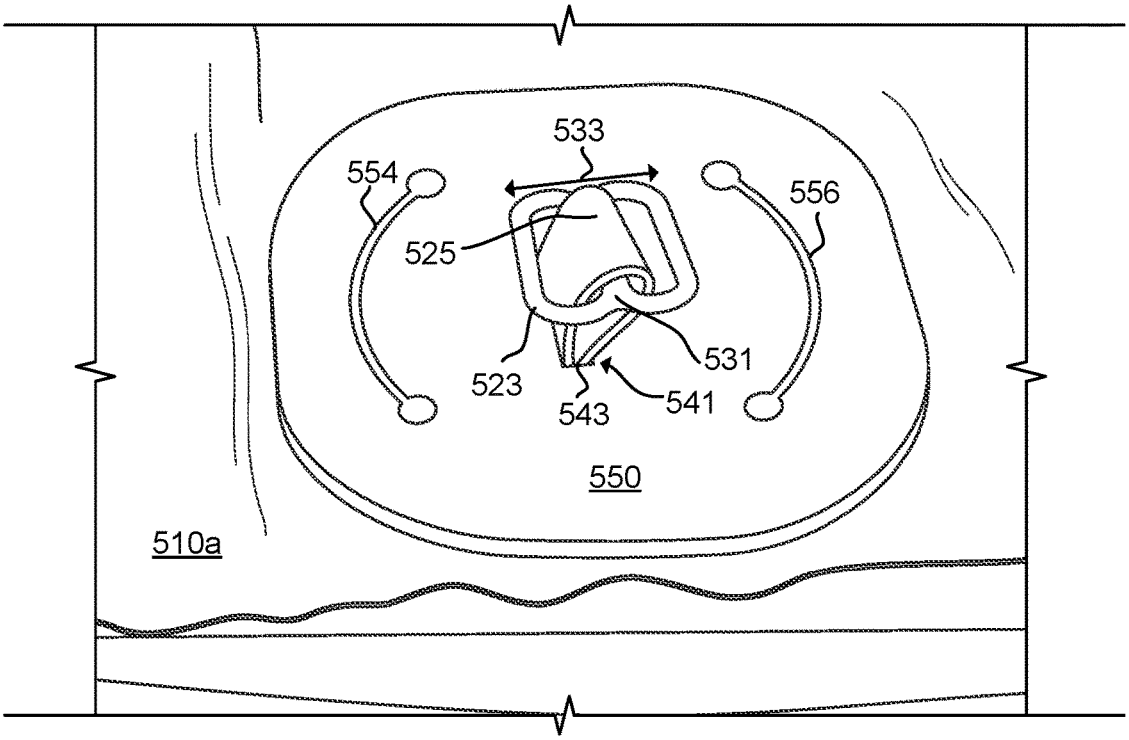
FIG. 8B is another top view of an internal side of a bottom layer of the mattress of FIG. 7.

In the depicted implementation of FIG. 5, the straps 522 are shown in an uninstalled configuration where the straps 522 are not secured to the mattress 502. As also shown in FIGS. 7, 8A, and 8B, each of the straps 522 can include a strap retainer 523, a loop 525, and a connector having first connector portion 526*a* that is configured to connect to a second connector portion (e.g., second connector portion 326*b*, 426*b*). The strap retainer 523 is connected to the loop 525 of the strap 522 at an end opposite the first portion 526*a* of the connector 526. The mattress 502 can include openings 541 in the bottom layer 510 of the mattress 502, and the openings 541 are configured to receive the strap retainers 523 to secure the straps 522 to the bottom layer 510 of the mattress 502. For example, the strap retainer 523 can be inserted through the opening 541 and can be secured by rotating the strap retainer 523 so that a width of the strap retainer 523 cannot be pulled through the opening 541 while the strap retainer 523 is positioned adjacent to an internal side of the bottom layer 510 of the mattress 502 (see e.g., FIGS. 7, 8A, and 8B that show an example strap 722 that shares features with the strap 522).

Referring to FIG. 5, in some cases, the mattress 502 can accommodate any number of straps 522 (e.g., two, three, four, five, six, eight, ten, twelve, fourteen, sixteen, eighteen, twenty, thirty, forty, fifty, or greater than fifty). In some cases, the straps 522 can be positioned at locations symmetrically along the mattress 502 to facilitate securement and alignment of the mattress to the foundation. In some instances, the positions of the straps 522 can be aligned with the connector assemblies (e.g., connector assemblies 424) to reduce or minimize the amount of shear force exerted on the mattress 502, preventing misalignment, separation, or detachment of the mattress from the foundation. Alternatively, in some cases, the straps 522 can be asymmetrically positioned along the bottom 510 of the mattress 502 to allow for easier movement and conformance of the mattress 502 when the foundation is articulated. The depicted mattress 502 can be compatible and couplable with a foundation mattress (see e.g., foundation 404) having a complementary set of connector assemblies (e.g., connector assemblies 424) attached along the surface of the foundation.

As shown in FIG. 5, the upper midsection 514*b* of the mattress 502 includes one set of two symmetrically positioned openings 541 and straps 522, and the foot section 514*d* includes a set of two symmetrically positioned openings 541 and straps 522. In some cases, some of the sections of the mattress 502 may not include connector openings 541 and straps 522 (e.g., the head section 514*a* and the lower midsection 514*c*). In some cases, any one section of the mattress 502 can include one or more sets of openings 541 and straps 522. In some cases, any one section of the mattress 502 can include one opening 541 and one strap 522 or a set (e.g., two pairs, each pair including an opening 541 and a strap 522) of connector openings 541 and straps 522, either symmetrically or asymmetrically positioned.

The mattress 502 can include a central portion 516 that is positioned between peripheral portions 518. The central portion 516 can align with the central portion 416 of the foundation 402, and the peripheral portions 518 can align with the peripheral portions 418 of the foundation 402. In the implementation depicted in FIG. 5, the openings 541 at the upper midsection 514*b* are located at peripheral portions 518 of the mattress 502. The openings 541 at the foot section 514*d* are positioned at peripheral portions 518 of the mattress 502. The straps 522 and openings 541 can be positioned to align with and connect to the connector assemblies 424 of the foundation 404 to connect the mattress 502 to the foundation 404.

Figure 6:
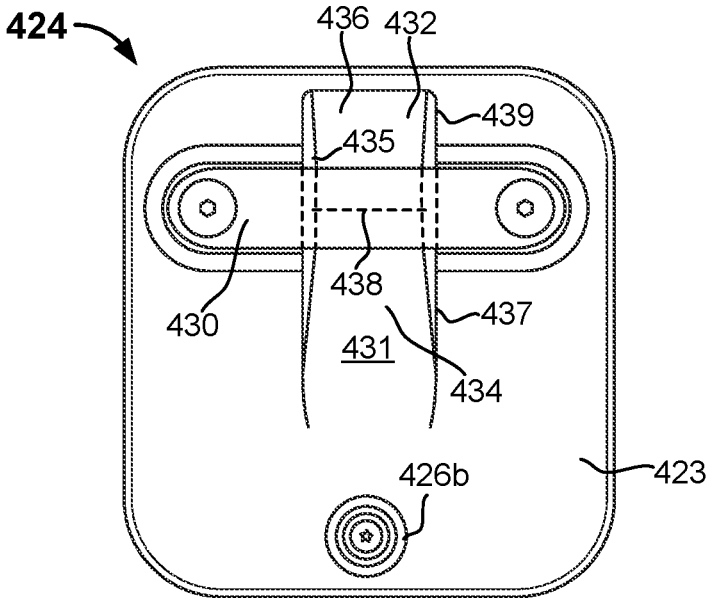
FIG. 6 is a top view of an example connector assembly.

FIG. 6 is a top view of an example connector assembly 424. The connector assembly 424 can share features with, be implemented as, and/or be interchangeable with the connector assembly 324 described herein. The connector assembly 424 can include a plate 423 that is attached to a foundation (e.g., the foundation 304, 404), and the connector assembly 424 can include a bar 430, a recessed plate 431, a channel 432, and a connector portion 426*b* (also referred to herein as a second portion 426*b* of the connector or a second connector portion 426*b*) that is configured to couple to the other connector portion 526*a* provided at a strap 522 in FIG. 7. Two connector portions 426*b* and 526*a* can be collectively referred to as a connector. The bar 430 can extend across the channel 432, and the channel 432 can extend beneath the bar 430. In some implementations, the bar 430 can be a nylon-glass bar, a metal bar, a plastic bar, a wooden bar, and combinations thereof.

In some implementations, the channel 432 extends below the surface of the plate 423 and above a recessed plate 431 that defines the bottom of the channel 432, and a portion of the channel 432 extends between the recessed plate 431 and the bar 430. The recessed plate 431 has side walls 435 that extend from the surface of the plate 423 to a depth to create an area for a strap (e.g., strap 322, 522) to pass through the channel 432 between the bar 430 and the recessed plate 431. The side walls 435 of the recessed plate 431 can extend to the depth that is below the top surface of a foundation (e.g., foundation 304, 404) such that recessed plate 431 is positioned at least partially below the top surface of the foundation. For example, the foundation can include an opening that aligns with the installed location of the connector assembly 424. The opening in the foundation facilitates an area for the recessed plate 431 to extend below both the plate 423 of the connector assembly 424 and the surface of the foundation. The recessed plate 431 can create a recessed area in the foundation for the channel 432 to receive a strap (e.g., strap 322, 522) through the channel 432. In some implementations, the recessed plate 431 that is positioned below the top surface of the foundation can facilitate improved connection and contouring between a mattress and a foundation.

In some implementations, the depth of the side walls 435 can be shallowest at each end of the channel 432 and deepest underneath the bar 430. The channel 432 can have a tapered depth, where the depth at the side walls 435 gradually increases from each end of the channel 432 to the deepest area (e.g., deepest portion 438) under the bar 430. The channel 432 can be arranged asymmetrically or biased with respect to the bar 430. For example, the channel 432 has or is split into a first section 434 and a second section 436, the first section 434 and the second section 436 can be separated at a deepest portion 438. The first section 434 of the channel 432 is arranged at a connector side 437 (e.g., a side close to the connector portion 426*b*) and the second section 436 of the channel 432 is arranged at an outer side 439 opposite to the connector side 437 with respect to the bar 430. In some implementations, the first section 434 can have a larger length than the second section 436. Further, the deepest depth of the channel 432 can be defined at the deepest portion 438 where the first and second sections 434, 436 meet each other. In some aspects, the depth 435 can have a maximum depth of between 1 and 20 mm, between 2 and 15 mm, between 5 and 14 mm, and about 12 mm.

The second portion 426*b* of the connector can be aligned with a center of the bar 430 and the channel 432, and spaced apart from the bar 430 and the channel 432. The second portion 426*b* of the connector can be configured to connect to a mating portion of the connector (see e.g., first portion 526*a* of FIG. 7) provided at the strap to secure the strap (e.g., strap 522) to the connector assembly 424. The second portion 426*b* of the connector can connect to the first portion of the connector when the strap passes through the channel 432.

The connector can be of various types that can provide mating connection. In some implementations, the connector is a snap connector that includes a post foot and a snap socket. For example, the post foot can be a male side of the snap connector and the snap socket can be a female side of the snap connector. The post foot and the snap socket can connect to each other via an interference fit with the snap socket receiving the post foot. In some implementations, the connector can include one or more fasteners, including snap-connectors, adjustable snap connectors, button connectors, buckle connectors, Velcro®, hook and loop fasteners, cam-lock fasteners, adhesives, and combinations thereof.

The second portion 426*b* of the connector can be a post foot that is attached to a surface of the foundation. The post foot can include the male side of the snap connector as shown in FIG. 6, which can be the post portion of the post foot. The post foot can additionally include a foot portion that connects the male side of the snap connector to the foundation. The foot portion can be a screw, a nail, a barbed fitting, or other fastener that connects the second portion 426*b* to the foundation. The second portion 426*b* can be partially recessed into the surface of the foundation to which the second portion 426*b* is attached. For example, the second portion 426*b* can be a post foot that is partially recessed into the surface of the foundation to which the post foot is attached. In some implementations, the male side of the snap connector can be recessed into a top surface of the foundation and the foot portion can be positioned entirely below the top surface of the foundation. In some implementations, the male side of the snap connector can be flush with a top surface of the foundation and the foot portion can be positioned entirely below the top surface of the foundation.

FIG. 7 is a bottom view of the mattress 502 having an example mattress opening 541 and a strap 522 that is configured to be inserted into the opening 541. FIG. 7 shows the strap 522 in an uninstalled configuration where the strap 522 is not secured to the mattress 502. The strap 522 can include a strap retainer 523 connected to a loop 525 of the strap 522 at an end opposite the first portion 526*a* of the connector. The strap retainer 523 can be sewn, looped, adhered, or otherwise attached to the strap 522. For example, the strap 522 includes the loop 525 that extends around a central portion (e.g., central bar 531 in FIG. 8B) of the strap retainer 523 to connect the strap 522 to the strap retainer 523. In some implementations, the loop 525 is sewn, looped, adhered, or otherwise attached to secure the strap retainer 523 to the strap 522. In some implementations, the strap retainer 523 can be a fastener such as a buckle, a snap, a clip, or other fastener.

The opening 541 can be defined at the bottom layer 510 of the mattress 502, and the opening 541 can be configured to receive the strap retainer 523 to secure the strap 522 to the bottom layer 510 of the mattress 502. In some implementations, the strap retainer 523 can be inserted through the opening 541 and can be secured by rotating the strap retainer 523 (e.g. 90 degrees) so that a width of the strap retainer 523 cannot be pulled through the opening 541 while the strap retainer 523 is positioned adjacent to an internal side of the bottom layer 510 of the mattress 502 (see e.g., FIGS. 8A and 8B).

The strap 522 includes the first portion 526*a* of the connector. In some implementations, the connector is a snap connector that includes a post foot and a snap socket. For example, the post foot can be a male side of the snap connector and the snap socket can be a female side of the snap connector. The post foot and the snap socket can connect to each other via an interference fit with the snap socket receiving the post foot.

The first portion 526*a* of the connector can be a snap socket that is attached to the strap 522. The snap socket can include the female side of the snap connector as shown in FIG. 7. The snap socket is configured to align with the post foot when the strap 522 extends through the channel.

FIGS. 8A and 8B show an internal side 510*a* of the bottom layer 510 of the mattress 502 of FIG. 7 with the strap retainer 523 and a portion of the strap 522 inserted through the opening 541. The loop 525 can extend around a central bar 531 of the strap retainer 523. The opening 541 can be configured to receive the strap retainer 523 to secure the strap 522 to the bottom layer 510 of the mattress 502. In some implementations, the strap retainer 523 can be inserted through the opening 541 to the internal side 510*a* and can be secured by rotating (e.g., 90 degrees) the strap retainer 523 (see orientation of FIG. 8B) so that a width 533 of the strap retainer 523 is arranged about perpendicular to the opening 541 so that the strap retainer 523 cannot be pulled through the opening 541 while the strap retainer 523 is positioned adjacent to an internal side of the bottom layer 510 of the mattress 502. The width 533 of the strap retainer 523 can be equal to or small than a width 543 of the opening 541 so that the strap retainer 523 can be easily inserted through the opening 541. In some aspects, however, the width 533 of the strap retainer 523 is greater than the width 543 of the opening 541 so that the strap retainer 523 is interference-fit into the opening 541, or that either of the strap retainer 523 or the opening 541 flexes to the extent that the strap retainer 523 passes through the opening 541 before it flexes back to its original shape.

In some implementations, a reinforcement patch 550 can be connected to the internal side 510*a* of the bottom layer 510 of the mattress. The reinforcement patch 550 can reduce or minimize the amount of shear force exerted on the bottom layer 510 of the mattress, and can distribute the forces exerted on the bottom layer 510 around the opening 541 to reduce or prevent tearing and stretching of the bottom layer 510 around the opening 541. The reinforcement patch 550 has a patch opening 551 that is aligned with the opening 541 in the bottom layer 510 of the mattress 502. In some implementations, the reinforcement patch 550 is adhered to the internal side 510*a* of the bottom layer 510 of the mattress 502. In some implementations, the reinforcement patch 550 has a first relief cut 554 and a second relief cut 556 that facilitate the distribution and management of the forces and stresses at the reinforcement patch 550 by reducing the stress concentrations around the patch opening 551. The first relief cut 554 and the second relief cut 556 are spaced apart from the patch opening 551. The first relief cut 554 and the second relief cut 556 can be symmetric relative to the patch opening 551, and the first relief cut 554 and the second relief cut 556 can be elongated cuts that extend generally along the periphery of the reinforcement patch 550.

Figure 9A:
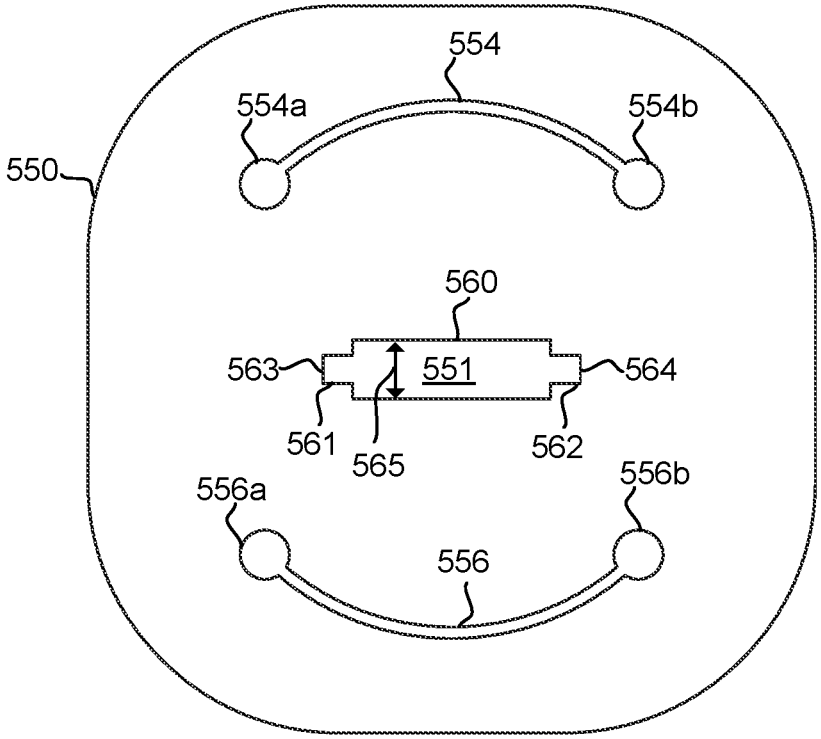
FIG. 9A is a top view of an example reinforcement patch.

FIG. 9A is a top view of the reinforcement patch 550. The reinforcement patch 550 has the patch opening 551 (i.e., the main slot) that can be aligned with the opening 541 in the bottom layer 510 of the mattress 502. In some implementations, the reinforcement patch 550 is adhered to the internal side 510*a* of the bottom layer 510 of the mattress 502. The patch opening 551 includes a main slot 560 and first and second lateral slots 561, and 562 at each end of the main slot 560. The first and second lateral slots 561, and 562 can have widths 563, and 564 that are less than the width 565 of the main slot 551.

The reinforcement patch 550 can have the first relief cut 554 and the second relief cut 556. The first relief cut 554 and the second relief cut 556 can form arced shapes that extend between two rounded openings 554*a*, 554*b*, 556*a*, and 556*b* at the ends of each relief cut 554, 556. The first relief cut 554 and the second relief cut 556 facilitate the distribution and management of the forces and stresses at the reinforcement patch 550 by reducing the stress concentrations around the patch opening 551. The first relief cut 554 and the second relief cut 556 increase the effective stiffness of the reinforcement patch 550 around the patch opening 551. The increased effective stiffness of the reinforcement patch 550 reduces the amount the reinforcement patch 550 will deflect in response to bending forces applied to the reinforcement patch 550 (e.g., as a result of articulation of the foundation). The reduced deflection of the reinforcement patch 550 around the patch opening 551 reduces the amount of stress applied around the patch opening 551 (e.g., between the relief cuts 554, 556 and the patch opening 551). The areas of the reinforcement patch 550 outside of the relief cuts 554, 556 (e.g., between the relief cuts 554, 556) and the edges of the reinforcement patch 550 have a lower effective stiffness than the areas between the relief cuts 554, 556 and the patch opening 551. The areas outside of the relief cuts 554, 556 facilitate bending of the outer portions of the relief patch 550 through a robust and predictable load path that is reduces stress concentrations.

Figure 9B:
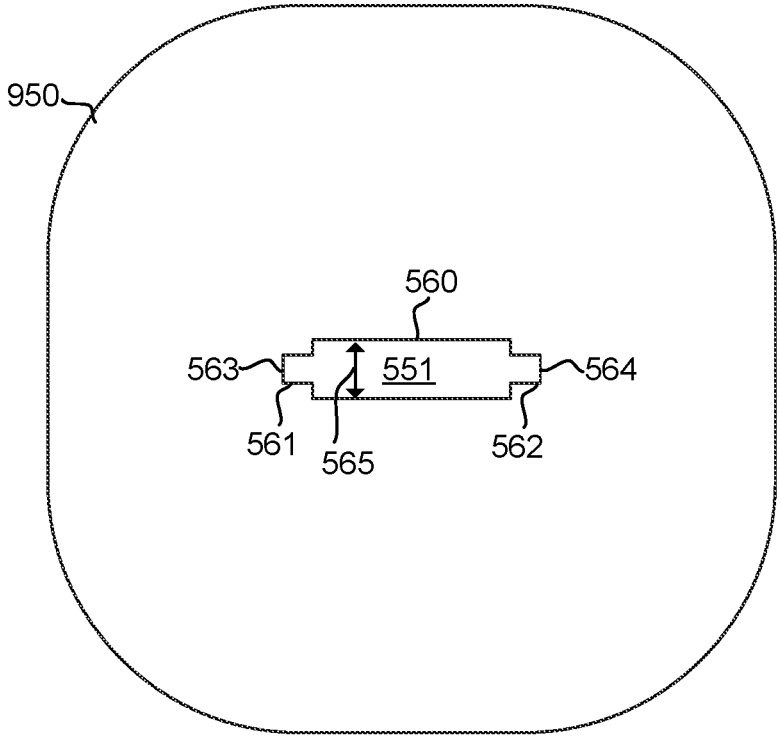
FIG. 9B is a top view of an example reinforcement patch.

FIG. 9B is a top view of another example reinforcement patch 950 that shares the features of reinforcement patch 550 except for the relief cuts.

Figure 10:
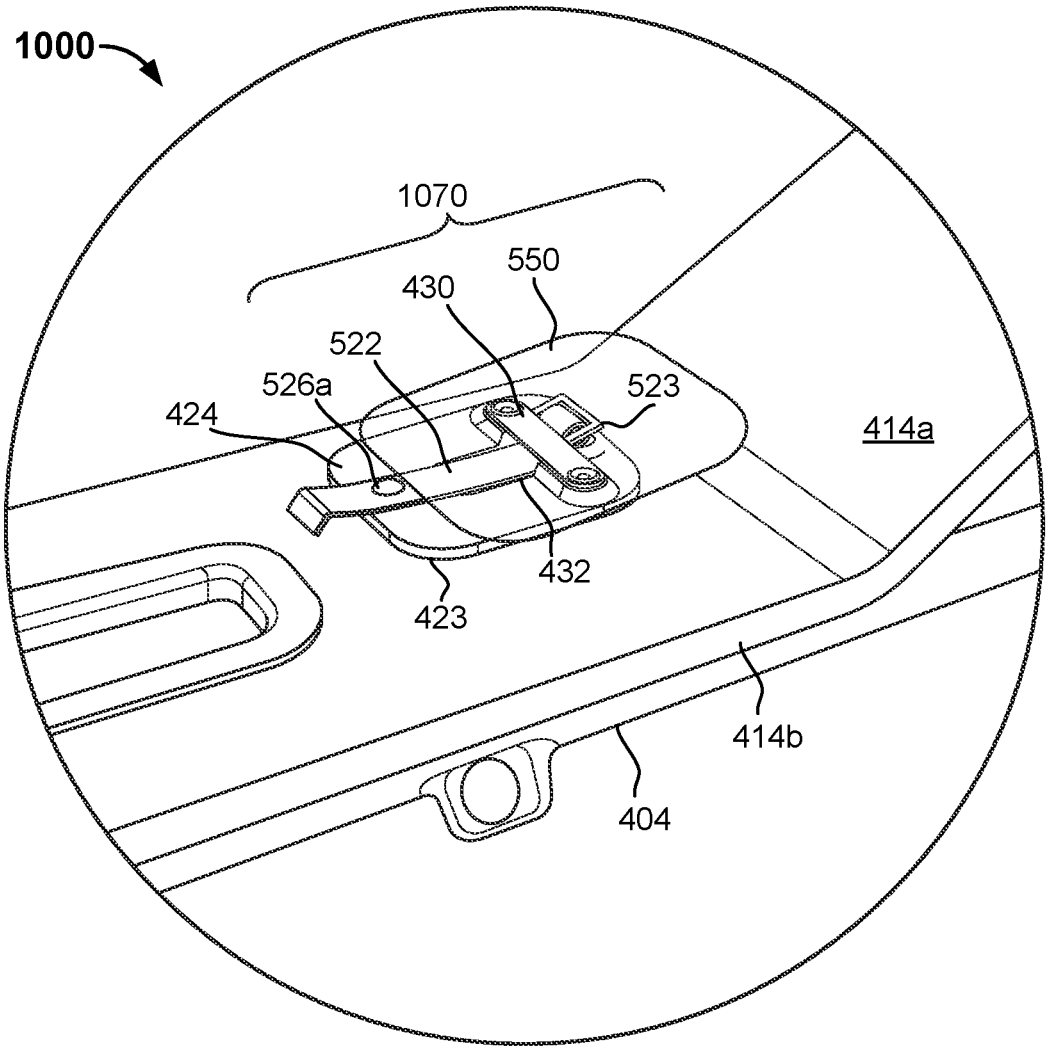
FIG. 10 is a perspective view of an example attachment assembly with a mattress removed from view.

FIG. 10 is a perspective view of an example bed system 1000 with an attachment mechanism 1070 and a mattress removed from view. A mattress (e.g., mattress 302, 502) would be positioned on the foundation 404, and is removed from view to illustrate an example of the assembled components of the attachment mechanism 1070. The attachment mechanism 1070 can include the strap 522, the reinforcement patch 550, and the connector assembly 424. The attachment mechanism 1070 can facilitate the connection of a mattress (e.g., mattress 502) to the foundation 404. In some implementations, the attachment mechanism 1070 can be positioned at the portion 414*b* and near the portion 414*a* of the foundation 404.

In some implementations, the strap 522 extends through reinforcement patch 550 and the openings in the patch and the bottom layer of the mattress (e.g., openings 541, 551). The strap retainer 523 is pulled into contact with the reinforcement patch 550 around the openings, and the strap retainer 523 can be pulled (e.g., tensile force) to engage (or be flush with) the reinforcement patch 550. The strap 522 can extend through the channel 432 and underneath the bar 430. The first portion 526*a* of the connector can connect to the second portion (see e.g., second portion 326*b*, 426*b*) of the connector assembly 424. In the depicted implementation, the first portion 526*b* is a snap receptacle that can connect to a post foot of the connector assembly 424. The strap 522 connected to the connector assembly 424 creates a tensile force that pulls against the strap retainer 523 to pull the mattress and secure the mattress to the foundation 404. The tensile force created by the connection of the strap 522 to the connector assembly 424 can reduce or minimize a gap between the mattress and the foundation 404. The reduced and/or minimized gap can provide improved contouring of the mattress to the foundation 404 as the foundation 404 is articulated into various positions.

In some implementations, a mattress (e.g., mattress 302, 502) can be connected to the foundation 404 by connecting the strap 522 to the connector assembly 424. For example, the strap 522 can be connected to the mattress 502 by inserting the strap retainer 523 through the opening 541 in the mattress 502 and the opening 551 in the reinforcement patch 550. The strap retainer 523 can be rotated (e.g., by 90 degrees) so that the strap retainer 523 can be passed through the openings 541, 551. The strap retainer 523 can be subsequently rotated (e.g., by 90 degrees with respect to the insertion orientation) where the strap retainer 523 cannot be passed through the openings 541, 551 to secure the strap 522 to the mattress 502.

The strap 522 can be passed through the channel 432 to connect to the connector assembly 424. For example, the strap 522 can be inserted into the second section 436 and can extend between the recessed plate 431 and the bar 430 through the first section 434 of the channel 432. The first portion 526*a* of the connector can be connected (e.g., snapped) to the second portion 426*b* of the connector with the strap 522 positioned in the channel 432 between the recessed plate 431 and the bar 430. The strap 522 can be connected to the connector assembly 424 and the bar 430 can facilitate a secure connection between the first portion 526*a* and the second portion 426*b* of the connector by preventing the strap 522 from disconnecting forces or movement (e.g., upward or downward movement of the strap 522) at the connector.

Figure 11:
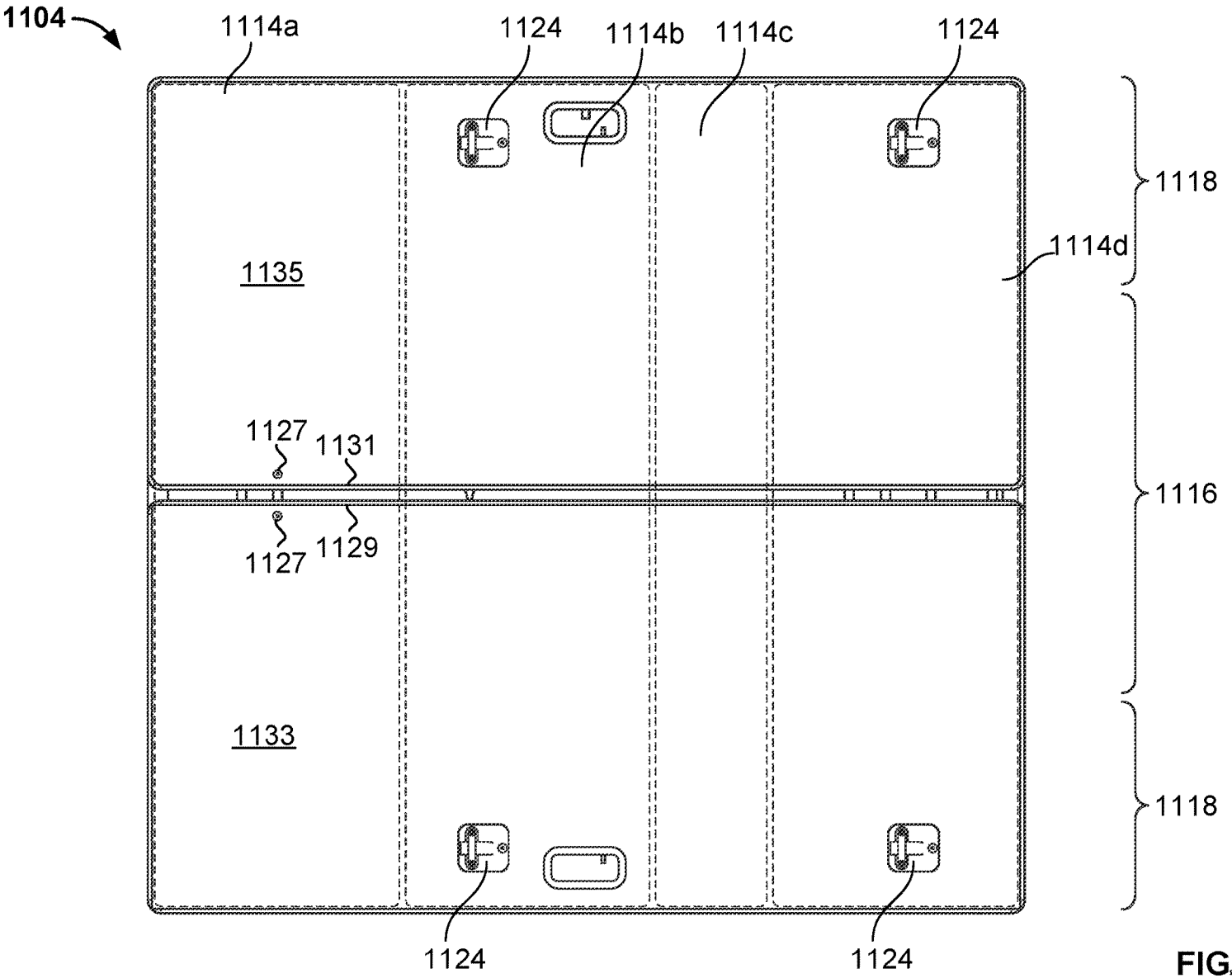
FIG. 11 is a top view of an example bed foundation with connector assemblies.

Referring to FIG. 11, some implementations of a foundation 1104 include connector assemblies 1124. The foundation 1104 and connector assemblies 1124 can share at least some features with the foundation 404 and connector assemblies 424. The head section 1114*a* of the foundation 1104 includes one set of two symmetrically positioned connectors 1127, the upper midsection 1114*b* of the foundation 1104 includes one set of two symmetrically positioned connector assemblies 1124, and the foot section 1114*d* includes a set of two symmetrically positioned connector assemblies 1124. In some cases, some of the articulable sections of the foundation 1104 may not include connector assemblies 1124 (e.g., the lower midsection 1114*c*). In some cases, any one section of the foundation 1104 can include one or more sets of connector assemblies 1124. In some cases, any one section of the foundation 1104 can include a single connector assembly or a set of connector assemblies, either symmetrically or asymmetrically positioned.

In FIG. 11, the connectors 1127 at the head section 1114*a* are located near a central portion 1116 of the foundation 1104. The connector assemblies 1124 at the upper midsection 1114*b* are located in a peripheral portion 1118 of the foundation 1104. The connector assemblies 1124 at the foot section 1114*d* are positioned at peripheral portions 1118 of the foundation 1104. The connectors 1127 at the head section 1114*a* are positioned along the inner edges 1129 and 1131 of the left head panel 1133 and right head panel 1135, respectively. In some cases, the pair of connectors 1127 at the head sections 1114*a* are positioned closer to one another than the pair of connector assemblies 1124 at the upper midsection 1114*b*. Such a configuration may be desirable in an articulable bed system having separately articulable head sections, such as an articulable bed system that is split with two separately articulable mattresses or an articulable bed system with a split head section and a joined foot section. In some cases, the connector assemblies 1124 may be positioned on the foundation 1104 such that the connector assemblies 1124 can be easily accessed during assembly and/or disassembly of the bed system.

Figure 12:
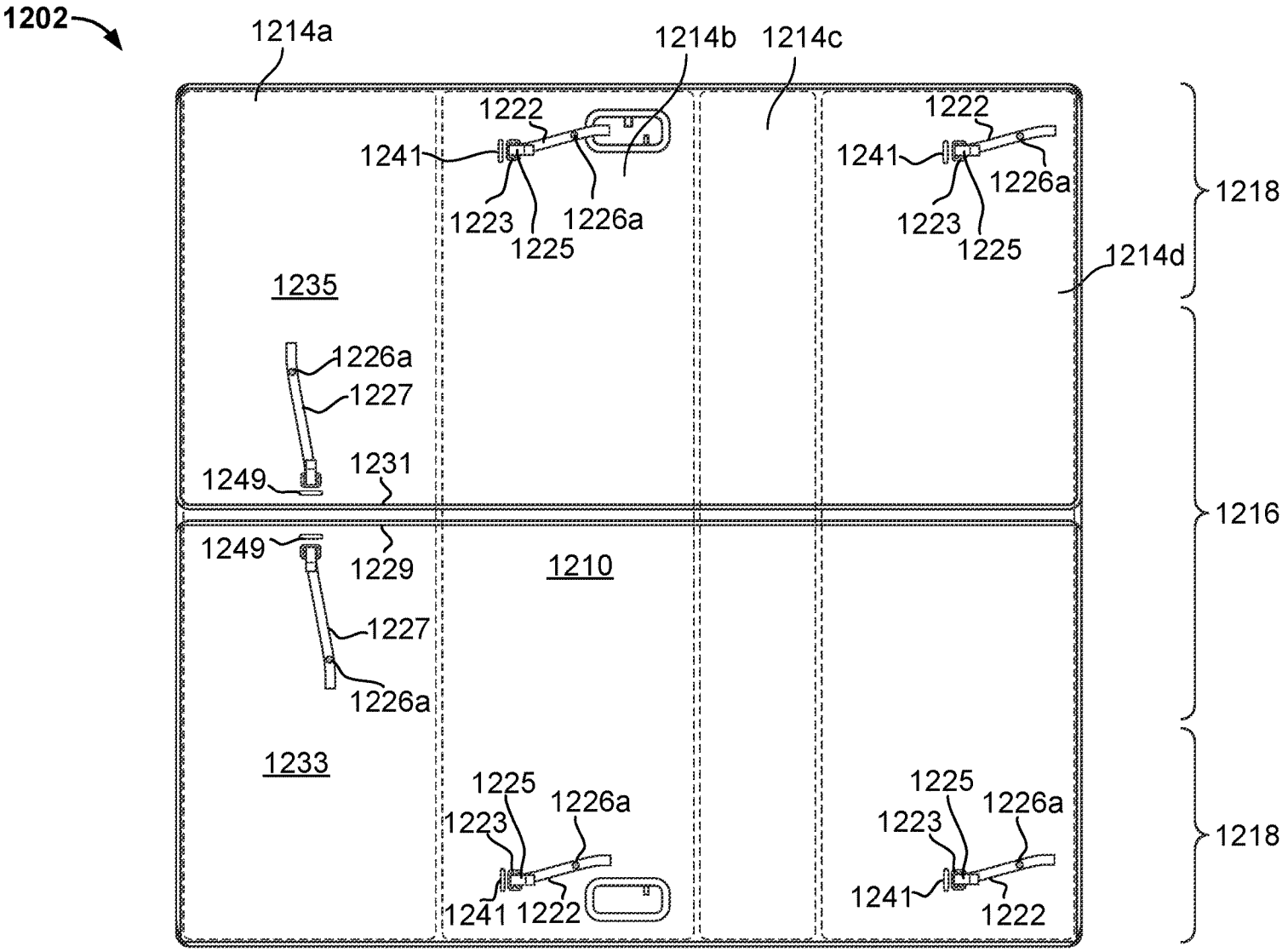
FIG. 12 is a bottom view of an example mattress with straps.

FIG. 12 shows a bottom view of an example mattress 1202 including six locations for attaching a strap 1222. The depicted mattress 1202 can be sized and shaped as any mattress size, for example, a king, a split-top king, a queen, a full, a twin, a twin XL sized mattress, or a custom-sized mattress. For example, the mattress 1202 can be a split-top king. The straps 1222 can be positioned at one or more locations along a bottom surface of the mattress 1202 such that straps 1222 interface with one or more connector assemblies (e.g., connector assemblies 1124 and connectors 1127) to secure the mattress 1202 to a foundation (e.g., foundation 304, 404, and 1104). In some implementations, the foundation 1104 and the mattress 1202 are configured to be connected to each other by connecting the straps 1222 to the connector assemblies 1124 and the head straps 1227 to the connectors 1127. The depicted mattress 1202 can include four sections: a head section 1214*a*, an upper midsection 1214*b*, a lower midsection 1214*c*, and a foot section 1214*d* that can be configured to align with the head section 1114*a*, an upper midsection 1114*b*, a lower midsection 1114*c*, and a foot section 1114*d* of the foundation 1104.

In the depicted implementation of FIG. 12, the straps 1222 and head straps 1227 are shown in an uninstalled configuration with the straps 1222 and head straps 1227 not secured to the mattress 1202. The head straps 1227 can be longer than the straps 1222, and can be arranged from left to right while the straps 1222 can be arranged from head to foot. The head straps 1227 can be longer to wrap around the foundation 1104 to connect to the connectors 1127 (see e.g., FIG. 13). The straps 1222 and head straps 1227 can include a strap retainer 1223 connected to a loop 1225 of the strap 1222 and head strap 1227 at an end opposite the first portion 1226*a* of the connector. The mattress 1202 can include openings 1241 and head openings 1249 in the bottom layer 1210 of the mattress 1202, and the openings 1241 and head openings 1249 are configured to receive the strap retainers 1223 to secure the straps 1222 and head straps 1227 to the bottom layer 1210 of the mattress 1202. For example, the strap retainer 1223 can be inserted through the openings 1241 and head openings 1249 and can be secured by rotating the strap retainer 1223 so that a width of the strap retainer 1223 cannot be pulled through the opening 1241 and head opening 1249 while the strap retainer 1223 is positioned adjacent to an internal side of the bottom layer 1210 of the mattress 1202 (see e.g., FIGS. 8A and 8B).

In some cases, the mattress 1202 can accommodate any number of straps 1222 (e.g., two, three, four, five, six, eight, ten, twelve, fourteen, sixteen, eighteen, twenty, thirty, forty, fifty, or greater than fifty) and any number of head straps 1227 (e.g., two, three, four, five, six, eight, ten, twelve, fourteen, sixteen, eighteen, twenty, thirty, forty, fifty, or greater than fifty). In some cases, the straps 1222 can be positioned at locations symmetrically along the mattress 1202 to facilitate securement and alignment of the mattress to the foundation. In some cases, the head straps 1227 can be positioned at locations symmetrically along the mattress 1202 to facilitate securement and alignment of the mattress to the foundation. In some instances, the positions of the straps 1222 can be aligned with the connector assemblies (e.g., connector assemblies 1124) and the head straps 1227 can be aligned with the connectors 1127 to reduce or minimize the amount of shear force exerted on the mattress 1202, preventing misalignment, separation, or detachment of the mattress from the foundation. Alternatively, in some cases, the straps 1222 can be asymmetrically positioned along the bottom 1210 of the mattress 1202 to allow for easier movement and conformance of the mattress 1202 when the foundation is articulated. The depicted mattress 1202 can be compatible and couplable with a foundation mattress (see e.g., foundation 1104) having a complementary set of connector assemblies (e.g., connector assemblies 1124) and connectors (e.g., connectors 1127) attached along the surface of the foundation.

As shown in FIG. 12, the openings 1249 at the head section 1214*a* are located near a central portion 1216 of the mattress 1202. The head straps 1227 and head openings 1249 at the head section 1114*a* are positioned along the inner edges 1229 and 1231 of the left head section 1233 and right head section 1235, respectively. In some cases, the pair of head openings 1249 at the head sections 1214*a* are positioned closer to one another than the pair of openings 1241 at the upper midsection 1214*b*. The openings 1249 can be arranged perpendicular to the openings 1241 to facilitate the head straps 1227 being arranged from left to right, while straps 1222 are arranged from head to foot.

The upper midsection 1214*b* of the mattress 1202 includes one set of two symmetrically positioned openings 1241 and straps 1222, and the foot section 1214*d* includes a set of two symmetrically positioned openings 1241 and straps 1222. In some cases, some of the sections of the mattress 1202 may not include connector openings 1241 and straps 1222 (e.g., the lower midsection 1214*c*). In some cases, any one section of the mattress 1202 can include one or more sets of openings 1241 and straps 1222. In some cases, any one section of the mattress 1202 can include one opening 1241 and one strap 1222 or a set (e.g., two pairs, each pair including an opening 1241 and a strap 1222) of connector openings 1241 and straps 1222, either symmetrically or asymmetrically positioned.

The mattress 1202 can include a central portion 1216 that is positioned between peripheral portions 1218. The central portion 1216 can align with the central portion 1116 of the foundation 1102, and the peripheral portions 1218 can align with the peripheral portions 1118 of the foundation 1102. In the implementation depicted in FIG. 12, the head openings 1249 at the head section 1214*a* are located at the central portion 1216 of the mattress 1202. The openings 1241 at the upper midsection 1214*b* are located at peripheral portions 1218 of the mattress 1202. The openings 1241 at the foot section 1214*d* are positioned at peripheral portions 1218 of the mattress 1202. The straps 1222 and openings 1241 and head straps 1227 and head openings 1249 can be positioned to align with and connect to the connector assemblies 1124 and connectors 1127 of the foundation 1104 to connect the mattress 1202 to the foundation 1104.

Figure 13:
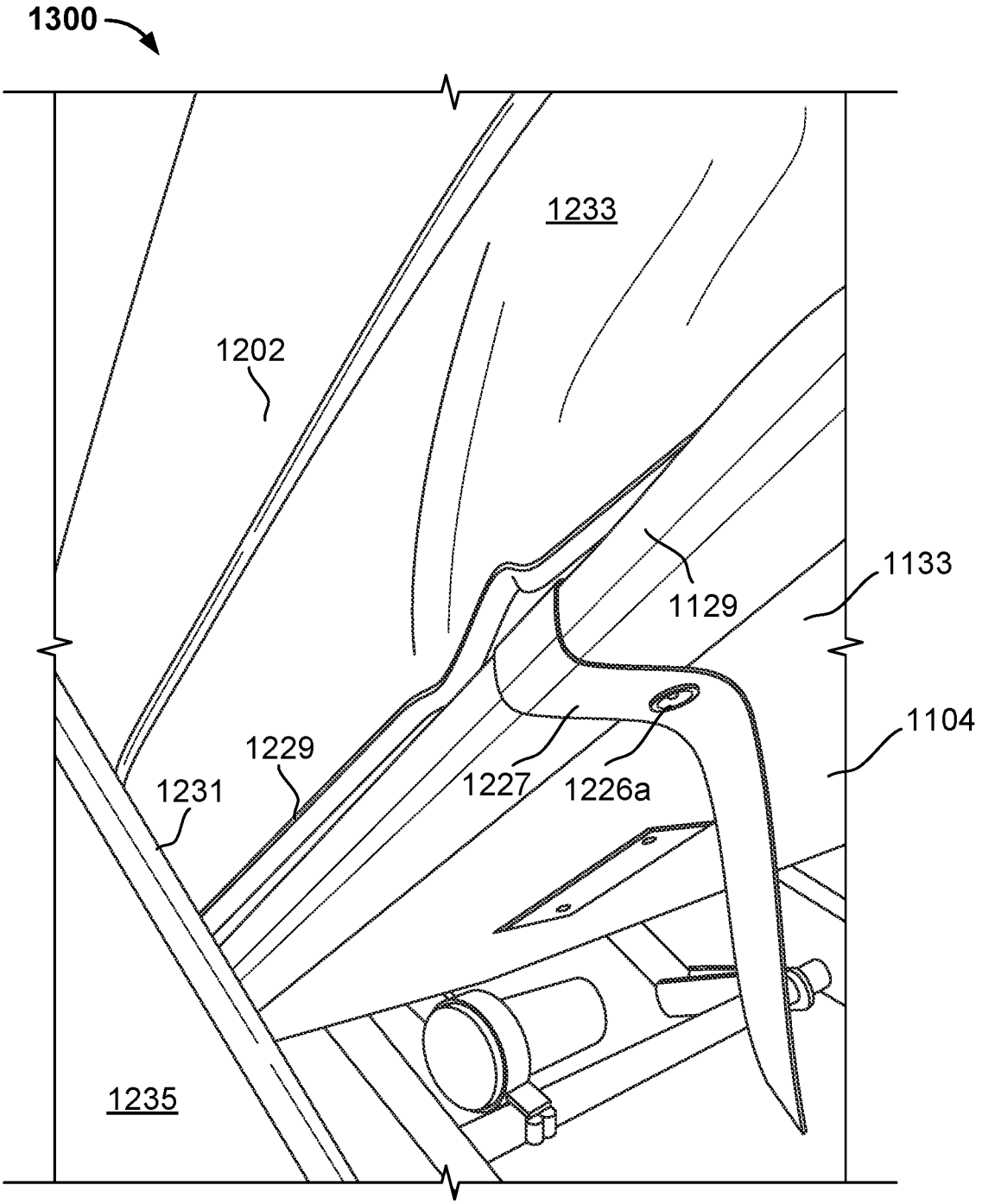
FIG. 13 is a perspective view of an example bed system with a left head section and a right head section.

FIG. 13 is a perspective view of a head end of an example bed system 1300 that includes the foundation 1104 and the mattress 1202 connected to each other. In the depicted implementation, the left head panel 1133 is articulated upwards while the right head section 1235 remains flat or unarticulated. The head strap 1227 can extend from the head opening (see e.g., head opening 1249) inward towards the inner edges 1129, and 1229 and the head strap 1227 wraps around the inner edge 1129 of the foundation 1104 so the first portion 1226*a* of the connector connects to the connectors 1127. The first portion 1226*a* and the connector 1127 can be a snap connector similar to the snap connector described with reference to connectors 326, and 526*a* connected to 426*b*. The head straps 1227 can pull each side (e.g., 1233, 1235 towards each other by pulling each side 1233, 1235 towards each respective inner edges 1129, 1229, 1131, and 1231.

Figure 14:
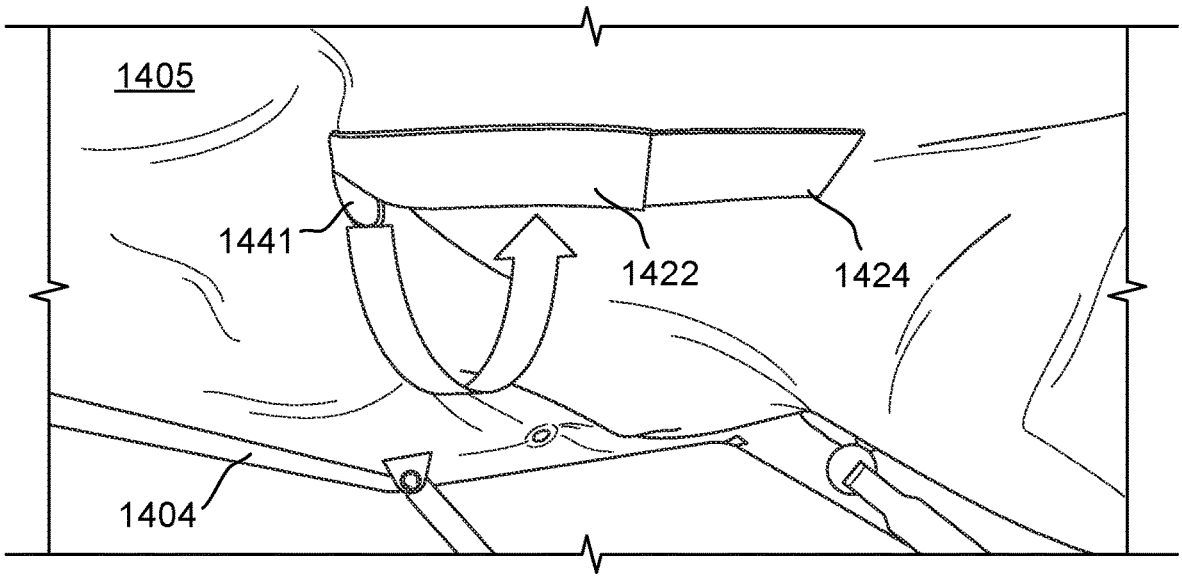
FIG. 14 is a bottom view of an example foot section of an example foundation.

FIG. 14 shows an example foot portion of a bottom layer 1405 of a foundation 1404 with a mattress attached to the top of the foundation 1404. The foundation 1404 is similar to or implements the foundations 304, 404 described herein, and the description of the foundations 304, 404 is similarly applied to the foundation 1404. The foundation 1404 can be an adjustable foundation (e.g., similar to foundation 304). The bottom layer 1405 can have one or more openings 1441. A connector 1424 can be positioned on the bottom layer 1405 of the foundation 1404 near the opening 1441. The connector 1424 can be aligned with the opening 1441. In some implementations, the mattress is positioned above the foundation 1404 and has a strap 1422 that extends from a bottom surface of the mattress. The strap 1422 can extend through the foundation 1404 (e.g., via a corresponding opening in the top surface of the foundation that is aligned with or otherwise connected to the opening 1441) and extend out of the opening 1441. The strap 1422 can connect to the connector 1424 to secure the mattress to the foundation 1404. In some implementations, the strap 1422 and the connector 1424 are connectable to each other via one or more fasteners, including snap-connectors, adjustable snap connectors, buckle connectors, Velcro®, hook and loop fasteners, cam-lock fasteners, adhesives, and combinations thereof. For example, the depicted implementation can include complimentary hook-and-loop style fasteners on the strap 1422 and the connector 1424 that facilitate the connection of the strap 1422 to the connector 1424 (e.g., the strap 1422 has a plurality of hooks and the connector 1424 has a plurality of loops, or the strap 1422 has a plurality of loops and the connector 1424 has a plurality of hooks). In some implementations, a Velcro® connection can facilitate the connection between the strap 1422 and the connector 1424.

Figure 15:
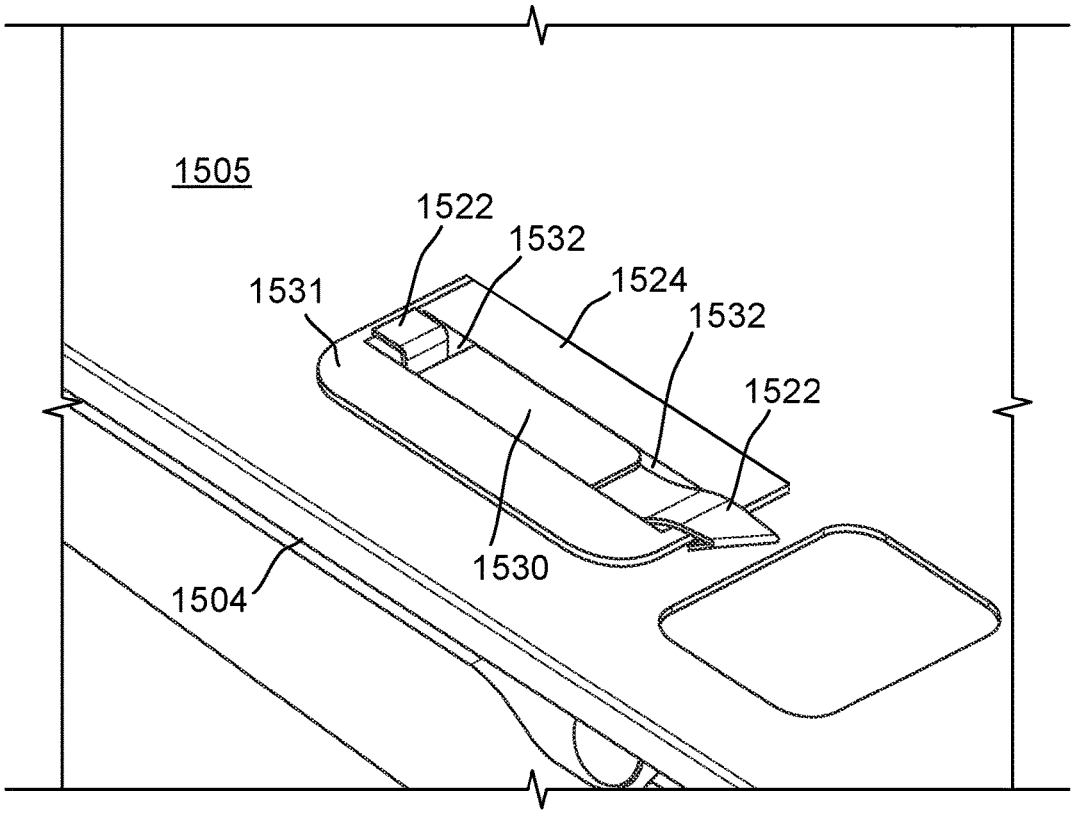
FIG. 15 is a top view of an example upper midsection of an example foundation.

FIG. 15 is a top view of an example upper midsection of an example foundation 1504 with a mattress removed from view. The foundation 1504 can include a connector assembly 1524 that is connected to a top surface 1505 of the foundation 1504. The connector assembly 1524 can include an arm 1530 that can be recessed flush with or below the top surface 1531 of the connector assembly 1524. In some implementations, the arm 1530 can be positioned in a channel 1532 of the connector assembly 1524. The channel 1532 can extend from head to foot on the foundation and can have a depth that is configured to receive a strap 1522. In some implementations, the mattress is positioned above the foundation and the strap 1522 extends from a bottom surface of the mattress and can be inserted into the channel 1532.

In some implementations, the connector assembly 1524 can releasably connect the mattress and the foundation 1504 by connecting the strap 1522 to the connector assembly 1524. For example, the arm 1530 can be rotated between a locked position (e.g., as depicted in FIG. 15) and an unlocked position. In the locked position, the arm 1530 can rotate into contact with the strap 1522 to impinge the strap 1522 in the channel 1532 to releasably secure the strap 1522 to the connector assembly 1524. In some implementations, the connector assembly 1524 can operate as a cam lock where the arm 1530 rotates to contact and lock the strap 1522 into the channel 1532 and rotates in the opposite direction (e.g., out of the channel 1532) to release the strap 1522.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input. The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet. The computing system can include clients and servers. A client and server are generally remote from each other and typically interact through a communication network. The relationship of client and server arises by virtue of computer programs running on the respective computers and having a client-server relationship to each other.

A number of aspects/implementations of the inventions have been described. Nevertheless, it will be understood that various modifications can be made without departing from the spirit and scope of the invention. For example, in some implementations the straps 322,522, 722, 1022, 1222, 1422, and 1522, and connector assemblies 324, 424, 1024, 1124, and 1524 can include components of different sizes, shapes, and orientations. Additionally, different features of different implementations of one of the implementations the bed 112, mattresses 302, 502, and 702, can be combined with other features of one or more other implementations of the legs 302, 502, and 702, as suitable for the application. Additionally, different features of different implementations of one of the implementations the foundation 304, 404, 1104, 1404, and 1504, can be combined with other features of one or more other implementations of foundation 304, 404, 1104, 1404, and 1504, as suitable for the application. Accordingly, other implementations are within the scope of the following claims.

What is claimed is:

1. A bed system comprising:

a foundation;

a mattress having a mattress cover surrounding the mattress, the mattress configured to be positioned on top of the foundation;

a mattress attachment mechanism configured to connect the mattress to the foundation, the mattress attachment mechanism comprising:

a strap configured to connect to the mattress and extending from the mattress by extending through a fabric opening in a bottom surface of the mattress cover, the strap having a first portion of a connector; and a connector assembly fixed to the foundation and including (i) a channel partially recessed below a top surface of the foundation and configured to allow the strap to pass therethrough, (ii) a bar that extends across the channel, and (iii) a second portion of the connector, wherein the strap is configured to, based on passing through the channel, extend under the bar, and wherein the second portion of the connector is configured to, based on the strap passing through the channel, connect to the first portion of the connector.

2. The bed system of claim 1, wherein the connector comprises a snap, the first portion of the connector is a post foot that is attached to a surface of the foundation and the second portion of the connector is a snap socket that is attached to the strap.

3. The bed system of claim 2, wherein the snap socket is configured to align with the post foot when the strap extends through the channel.

4. The bed system of claim 2, wherein the post foot of the snap is partially recessed into the surface of the foundation to which the post foot is attached.

5. The bed system of claim 1, wherein the bar comprises a glass-filled nylon.

6. The bed system of claim 1, further comprising a second strap configured to connect the mattress to the foundation, the second strap having a first portion of a connector at an end of the strap, wherein the first portion of the connector comprises a snap having a first snap portion attached to the strap and a second snap portion attached to a bottom of a panel of the foundation.

7. The bed system of claim 6, wherein the second strap is longer than the strap.

8. The bed system of claim 1, wherein the foundation comprises an adjustable foundation configured for raising both a head and feet of the mattress when the adjustable foundation is actuated.

9. The bed system of claim 8, wherein the mattress attachment mechanism retains the mattress on the adjustable foundation during articulation of the adjustable foundation.

10. The bed system of claim 1, wherein the foundation comprises a first articulable panel and a second articulable panel, the mattress attachment mechanism is positioned at a joint between the first and second panels.

11. A bed system comprising:

a foundation;

a mattress configured to be positioned on top of the foundation;

a mattress attachment mechanism configured to connect the mattress to the foundation, the mattress attachment mechanism comprising:

a strap configured to connect to the mattress and extending from the mattress, the strap having a first portion of a connector; and a connector assembly fixed to the foundation and including (i) a channel partially recessed below a top surface of the foundation and configured to allow the strap to pass therethrough, (ii) a bar that extends across the channel, and (iii) a second portion of the connector, wherein the strap is configured to, based on passing through the channel, extend under the bar, wherein the second portion of the connector is configured to, based on the strap passing through the channel, connect to the first portion of the connector, and wherein the mattress attachment mechanism comprises a reinforcement patch having a patch opening that is aligned with a fabric opening in a bottom layer of the mattress.

12. The bed system of claim 11, wherein the reinforcement patch has a first relief cut and a second relief cut.

13. The bed system of claim 11, wherein the patch opening includes a main slot and first and second lateral slots at each end of the main slot, the first and second lateral slots having widths less than the width of the main slot.

14. The bed system of claim 11, wherein the reinforcement patch is adhered to an internal side of the bottom layer of the mattress.

15. The bed system of claim 11, further comprising a strap retainer attached to a loop of the strap, the strap retainer is positioned adjacent to an internal side of the bottom layer of the mattress.

16. A bed system comprising:

a foundation;

a mattress configured to be positioned on top of the foundation;

a mattress attachment mechanism configured to connect the mattress to the foundation, the mattress attachment mechanism comprising:

a strap configured to connect to the mattress and extending from the mattress, the strap having a first portion of a connector;

a connector assembly fixed to the foundation and including (i) a channel partially recessed below a top surface of the foundation and configured to allow the strap to pass therethrough, (ii) a bar that extends across the channel, and (iii) a second portion of the connector; and a second strap configured to connect the mattress to the foundation, the second strap having a first portion of a connector at an end of the strap, wherein the first portion of the connector comprises a snap having a first snap portion attached to the strap and a second snap portion attached to a bottom of a panel of the foundation, wherein the strap is configured to, based on passing through the channel, extend under the bar, wherein the second portion of the connector is configured to, based on the strap passing through the channel, connect to the first portion of the connector, and wherein the foundation comprises a left head panel and a right head panel each having inner edges and outer edges, wherein the second snap portion is positioned proximate to the inner edge of one of the left head panel or the right head panel.

17. A method of assembling a bed system comprising:

positioning a mattress on a foundation, the mattress having a mattress cover surrounding the mattress and a strap extending through a fabric opening in a bottom surface of the mattress cover, and the foundation having a connector assembly configured to engage the strap;

passing the strap of the mattress between a bar and a channel of the connector assembly of the foundation; and based on the strap passing between the bar and the channel of the connector assembly, connecting a first connector portion of strap to a second connector portion of the connector assembly to thereby connect the mattress to the foundation.

18. The method of claim 17, wherein the connector comprises a snap, the first portion of the connector is a post foot that is attached to a surface of the foundation and the second portion of the connector is a snap socket that is attached to the strap.

19. The method of claim 18, wherein the snap socket is configured to align with the post foot when the strap extends through the channel.

20. The method of claim 18, wherein the post foot of the snap is partially recessed into the surface of the foundation to which the post foot is attached.

* * * * *